US010704128B2

(12) United States Patent
Das et al.

(10) Patent No.: US 10,704,128 B2
(45) Date of Patent: Jul. 7, 2020

(54) HIGH-STRENGTH CORROSION-RESISTANT ALUMINUM ALLOYS AND METHODS OF MAKING THE SAME

(71) Applicant: Novelis Inc., Atlanta, GA (US)

(72) Inventors: Sazol Das, Acworth, GA (US); Hany Ahmed, Atlanta, GA (US); Wei Wen, Powder Springs, GA (US)

(73) Assignee: NOVELIS INC., Atlanta, GA (US)

( * ) Notice: Subject to any disclaimer, the term of this patent is extended or adjusted under 35 U.S.C. 154(b) by 288 days.

(21) Appl. No.: 15/645,103

(22) Filed: Jul. 10, 2017

(65) Prior Publication Data

US 2019/0010591 A1 Jan. 10, 2019

(51) Int. Cl.

| | |
|---|---|
| ***C22F 1/043*** | (2006.01) |
| ***C22C 21/08*** | (2006.01) |
| ***C22F 1/047*** | (2006.01) |
| ***C22C 21/02*** | (2006.01) |

(52) U.S. Cl.

CPC ..... *C22F 1/047* (2013.01); *C22C 21/02* (2013.01); *C22C 21/08* (2013.01); *C22F 1/043* (2013.01)

(58) Field of Classification Search

CPC ..... C22C 21/00–18; C22F 1/04–057

See application file for complete search history.

(56) References Cited

U.S. PATENT DOCUMENTS

| | | | | |
|---|---|---|---|---|
| 2012/0186706 | A1 | 7/2012 | Krajewski | |
| 2014/0003993 | A1 | 1/2014 | Matsumoto et al. | |
| 2014/0322558 | A1 | 10/2014 | Takeda et al. | |
| 2015/0316210 | A1 | 11/2015 | Nakai et al. | |
| 2017/0175239 | A1* | 6/2017 | Ahmed | C22F 1/043 |

OTHER PUBLICATIONS

"International Alloy Designations and Chemical Composition Limits for Wrought Aluminum and Wrought Aluminum Alloys," Registration Record Series: Teal Sheets, Feb. 1, 2009, The Aluminum Association, Inc., 35 pages.

International Patent Application No. PCT/US2017/041313, International Search Report and Written Opinion dated Aug. 17, 2017, 11 pages.

* cited by examiner

*Primary Examiner* — Lois L Zheng

(74) *Attorney, Agent, or Firm* — Kilpatrick Townsend & Stockton LLP

(57) ABSTRACT

Disclosed are high-strength aluminum alloys and methods of making and processing such alloys. The aluminum alloys described herein exhibit improved mechanical strength, deformability, and corrosion resistance properties. In addition, the aluminum alloys can be prepared from recycled materials. The aluminum alloy products prepared from the alloys described herein include precipitates to enhance strength, such as $MgZn_2/Mg(Zn,Cu)_2$, $Mg_2Si$, and $Al_4Mg_8Si_7Cu_2$.

30 Claims, 28 Drawing Sheets

HIGH-STRENGTH CORROSION-RESISTANT ALUMINUM ALLOYS AND METHODS OF MAKING THE SAME

FIELD

The present disclosure relates to aluminum alloys and methods of making and processing the same. The present disclosure further relates to aluminum alloys exhibiting high mechanical strength, formability, and corrosion resistance.

BACKGROUND

Recyclable aluminum alloys with high strength are desirable for improved product performance in many applications, including transportation (encompassing without limitation, e.g., trucks, trailers, trains, and marine) applications, electronics applications, and automobile applications. For example, a high-strength aluminum alloy in trucks or trailers would be lighter than conventional steel alloys, providing significant emission reductions that are needed to meet new, stricter government regulations on emissions. Such alloys should exhibit high strength, high formability, and corrosion resistance. Further, it is desirable for such alloys to be formed from recycled content.

However, identifying processing conditions and alloy compositions that will provide such an alloy, particularly with recycled content, has proven to be a challenge. Forming alloys from recycled content may lead to higher zinc (Zn) and copper (Cu) content. Higher Zn alloys traditionally lack strength, and Cu-containing alloys are susceptible to corrosion.

SUMMARY

Covered embodiments of the invention are defined by the claims, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification, any or all drawings, and each claim.

Described herein are aluminum alloys comprising about 0.25-1.3 wt. % Si, 1.0-2.5 wt. % Mg, 0.5-1.5 wt. % Cu, up to 0.2 wt. % Fe, up to 3.0 wt. % Zn, up to 0.15 wt. % impurities, with the remainder as Al. In some cases, the aluminum alloys can comprise about 0.55-1.1 wt. % Si, 1.25-2.25 wt. % Mg, 0.6-1.0 wt. % Cu, 0.05-0.17 wt. % Fe, 1.5-3.0 wt. % Zn, up to 0.15 wt. % impurities, with the remainder as Al. In some cases, the aluminum alloys can comprise about 0.65-1.0 wt. % Si, 1.5-2.25 wt. % Mg, 0.6-1.0 wt. % Cu, 0.12-0.17 wt. % Fe, 2.0-3.0 wt. % Zn, up to 0.15 wt. % impurities, with the remainder as Al. Optionally, the aluminum alloys described herein can further comprise Zr and/or Mn. The Zr can be present in an amount of up to about 0.15 wt. % (e.g., from about 0.09-0.12 wt. %). The Mn can be present in an amount of up to about 0.5 wt. % (e.g., from about 0.05-0.3 wt. %).

Optionally, the ratio of Mg to Si (i.e., the Mg/Si ratio) is from about 1.5 to 1 to about 3.5 to 1. For example, the Mg/Si ratio can be from about 2.0 to 1 to about 3.0 to 1. Optionally, the ratio of Zn to the Mg/Si ratio (i.e., the Zn/(Mg/Si) ratio) is from about 0.75 to 1 to about 1.4 to 1. For example, the Zn/(Mg/Si) ratio can be from about 0.8 to 1 to about 1.1 to 1. Optionally, the ratio of Cu to the Zn/(Mg/Si) ratio (i.e., the Cu/[Zn/(Mg/Si)] ratio) is from about 0.7 to 1 to about 1.4 to 1. For example, the Cu/[Zn/(Mg/Si)] ratio is from about 0.8 to 1 to about 1.1 to 1.

Also described herein are aluminum alloy products comprising the aluminum alloy as described herein. The aluminum alloy product can have a yield strength of at least about 340 MPa (e.g., from about 360 MPa to about 380 MPa) in the T6 temper. The aluminum alloy products described herein are corrosion resistant and can have an average intergranular corrosion pit depth of less than about 100 μm in the T6 temper. The aluminum alloy products also display excellent bendability and can have an r/t (bendability) ratio of about 0.5 or less in the T4 temper.

Optionally, the aluminum alloy product comprises one or more precipitates selected from the group consisting of $MgZn_2/Mg(Zn,Cu)_2$, $Mg_2Si$, and $Al_4Mg_8Si_7Cu_2$. The aluminum alloy product can comprise $MgZn_2/Mg(Zn,Cu)_2$ in an average amount of at least about 300,000,000 particles per $mm^2$, $Mg_2Si$ in an average amount of at least about 600,000,000 particles per $mm^2$, and/or $Al_4Mg_8Si_7Cu_2$ in an average amount of at least about 600,000,000 particles per $mm^2$. In some examples, the aluminum alloy product comprises $MgZn_2/Mg(Zn,Cu)_2$, $Mg_2Si$, and $Al_4Mg_8Si_7Cu_2$. A ratio of $Mg_2Si$ to $Al_4Mg_8Si_7Cu_2$ can be from about 1:1 to about 1.5:1, a ratio of $Mg_2Si$ to $MgZn_2/Mg(Zn,Cu)_2$ can be from about 1.5:1 to about 3:1, and a ratio of $Al_4Mg_8Si_7Cu_2$ to $MgZn_2/Mg(Zn,Cu)_2$ can be from about 1.5:1 to about 3:1.

Further described herein is a method of producing an aluminum alloy. The method comprises casting an aluminum alloy as described herein to form an aluminum alloy cast product, homogenizing the aluminum alloy cast product, hot rolling the homogenized aluminum alloy cast product to provide a final gauge aluminum alloy, and solution heat treating the final gauge aluminum alloy. The method can further comprise pre-aging the final gauge aluminum alloy. Optionally, the aluminum alloy is cast from a molten aluminum alloy comprising scrap metal, such as from scrap metal containing a 6xxx series aluminum alloy, a 7xxx series aluminum alloy, or a combination of these.

DETAILED DESCRIPTION

Figure 1:
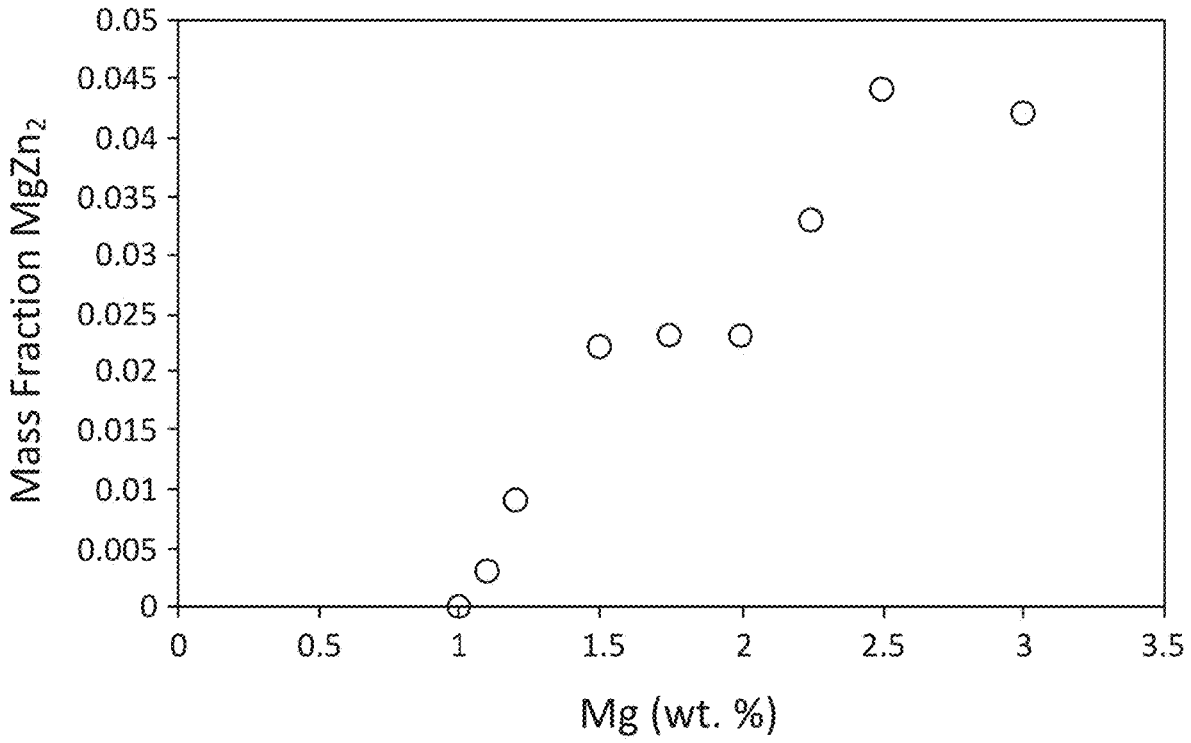
FIG. 1 is a graph showing an increase in magnesium zinc precipitates with increased magnesium content in aluminum alloys prepared according to certain aspects of the present disclosure.

Described herein are high-strength aluminum alloys and methods of making and processing such alloys. The aluminum alloys described herein exhibit improved mechanical strength, deformability, and corrosion resistance properties. In addition, the aluminum alloys can be prepared from recycled materials. Aluminum alloy products prepared from the alloys described herein include precipitates to enhance strength, such as $MgZn_2/Mg(Zn,Cu)_2$, $Mg_2Si$, and $Al_4Mg_8Si_7Cu_2$.

Definitions and Descriptions

The terms "invention," "the invention," "this invention" and "the present invention" used herein are intended to refer broadly to all of the subject matter of this patent application and the claims below. Statements containing these terms should be understood not to limit the subject matter described herein or to limit the meaning or scope of the patent claims below.

In this description, reference is made to alloys identified by aluminum industry designations, such as "series" or "6xxx." For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot," both published by The Aluminum Association.

As used herein, the meaning of "a," "an," or "the" includes singular and plural references unless the context clearly dictates otherwise.

As used herein, a plate generally has a thickness of greater than about 6 mm. For example, a plate may refer to an aluminum product having a thickness of greater than 6 mm, greater than 10 mm, greater than 15 mm, greater than 20 mm, greater than 25 mm, greater than 30 mm, greater than 35 mm, greater than 40 mm, greater than 45 mm, greater than 50 mm, or greater than 100 mm.

As used herein, the term "slab" indicates an alloy thickness in a range of approximately 5 mm to approximately 50 mm. For example, a slab may have a thickness of 5 mm, 10 mm, 15 mm, 20 mm, 25 mm, 30 mm, 35 mm, 40 mm, 45 mm, or 50 mm.

As used herein, a shate (also referred to as a sheet plate) generally has a thickness of from about 4 mm to about 15 mm. For example, a shate may have a thickness of 4 mm, 5 mm, 6 mm, 7 mm, 8 mm, 9 mm, 10 mm, 11 mm, 12 mm, 13 mm, 14 mm, or 15 mm.

As used herein, a sheet generally refers to an aluminum product having a thickness of less than about 4 mm. For example, a sheet may have a thickness of less than 4 mm, less than 3 mm, less than 2 mm, less than 1 mm, less than 0.5 mm, less than 0.3 mm, or less than 0.1 mm.

Reference is made in this application to alloy temper or condition. For an understanding of the alloy temper descriptions most commonly used, see "American National Standards (ANSI) H35 on Alloy and Temper Designation Systems." An F condition or temper refers to an aluminum alloy as fabricated. An O condition or temper refers to an aluminum alloy after annealing. A T4 condition or temper refers to an aluminum alloy after solution heat treatment (SHT) (i.e., solutionization) followed by natural aging. A T6 condition or temper refers to an aluminum alloy after solution heat treatment followed by artificial aging (AA). A T8x condition or temper refers to an aluminum alloy after solution heat treatment, followed by cold working and then by artificial aging.

As used herein, terms such as "cast metal article," "cast article," and the like are interchangeable and refer to a product produced by direct chill casting (including direct chill co-casting) or semi-continuous casting, continuous casting (including, for example, by use of a twin belt caster, a twin roll caster, a block caster, or any other continuous caster), electromagnetic casting, hot top casting, or any other casting method.

As used herein, the meaning of "room temperature" can include a temperature of from about 15° C. to about 30° C., for example about 15° C., about 16° C., about 17° C., about 18° C., about 19° C., about 20° C., about 21° C., about 22° C., about 23° C., about 24° C., about 25° C., about 26° C., about 27° C., about 28° C., about 29° C., or about 30° C.

All ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10.

The following aluminum alloys are described in terms of their elemental composition in weight percentage (wt. %) based on the total weight of the alloy. In certain examples of each alloy, the remainder is aluminum, with a maximum wt. % of 0.15% for the sum of the impurities.

Alloy Compositions

Described below are novel aluminum alloys. In certain aspects, the alloys exhibit high strength, high formability, and corrosion resistance. The properties of the alloys are achieved due to the elemental compositions of the alloys as well as the methods of processing the alloys to produce aluminum alloy products, including sheets, plates, and shates.

In certain aspects, for a combined effect of strengthening, formability, and corrosion resistance, the alloy has a Cu content of from about 0.5 wt. % to about 1.5 wt. %, a Zr content of from 0.07 wt. % to about 0.12 wt. %, and a controlled Si to Mg ratio, as further described below.

The alloys can have the following elemental composition as provided in Table 1:

TABLE 1

| Element | Weight Percentage (wt. %) |
|---|---|
| Si | 0.25-1.3 |
| Fe | 0-0.2 |
| Mn | 0-0.5 |
| Mg | 1.0-2.5 |
| Cu | 0.5-1.5 |
| Zn | 0-3.0 |
| Zr | 0-0.15 |
| Others | 0-0.05 (each)<br>0-0.15 (total) |
| Al | Remainder |

In some examples, the alloys can have the following elemental composition as provided in Table 2.

TABLE 2

| Element | Weight Percentage (wt. %) |
|---|---|
| Si | 0.55-1.1 |
| Fe | 0.05-0.17 |
| Mn | 0.05-0.3 |
| Mg | 1.25-2.25 |
| Cu | 0.6-1.0 |
| Zn | 1.5-3.0 |
| Zr | 0.09-0.12 |
| Others | 0-0.05 (each)<br>0-0.15 (total) |
| Al | Remainder |

In some examples, the alloys can have the following elemental composition as provided in Table 3.

TABLE 3

| Element | Weight Percentage (wt. %) |
|---|---|
| Si | 0.65-1.0 |
| Fe | 0.12-0.17 |
| Mn | 0.05-0.2 |
| Mg | 1.5-2.25 |
| Cu | 0.6-1.0 |
| Zn | 2.0-3.0 |
| Zr | 0.08-0.11 |
| Others | 0-0.05 (each)<br>0-0.15 (total) |
| Al | Remainder |

In some examples, the disclosed alloy includes silicon (Si) in an amount from about 0.25% to about 1.3% (e.g., from about 0.55% to about 1.1% or from about 0.65% to about 1.0%) based on the total weight of the alloy. For example, the alloy can include about 0.25%, about 0.26%, about 0.27%, about 0.28%, about 0.29%, about 0.3%, about 0.31%, about 0.32%, about 0.33%, about 0.34%, about 0.35%, about 0.36%, about 0.37%, about 0.38%, about 0.39%, about 0.4%, 0.41%, about 0.42%, about 0.43%, about 0.44%, about 0.45%, about 0.46%, about 0.47%, about 0.48%, about 0.49%, about 0.5%, about 0.51%, about 0.52%, about 0.53%, about 0.54%, about 0.55%, about 0.56%, about 0.57%, about 0.58%, about 0.59%, about 0.6%, about 0.61%, about 0.62%, about 0.63%, about 0.64%, about 0.65%, about 0.66%, about 0.67%, about 0.68%, about 0.69%, about 0.7%, about 0.71%, about 0.72%, about 0.73%, about 0.74%, about 0.75%, about 0.76%, about 0.77%, about 0.78%, about 0.79%, about 0.8%, about 0.81%, about 0.82%, about 0.83%, about 0.84%, about 0.85%, about 0.86%, about 0.87%, about 0.88%, about 0.89%, about 0.9%, about 0.91%, about 0.92%, about 0.93%, about 0.94%, about 0.95%, about 0.96%, about 0.97%, about 0.98%, about 0.99%, about 1.0%, about 1.01%, about 1.02%, about 1.03%, about 1.04%, about 1.05%, about 1.06%, about 1.07%, about 1.08%, about 1.09%, about 1.1%, about 1.11%, about 1.12%, about 1.13%, about 1.14%, about 1.15%, about 1.16%, about 1.17%, about 1.18%, about 1.19%, about 1.2%, about 1.21%, about 1.22%, about 1.23%, about 1.24%, about 1.25%, about 1.26%, about 1.27%, about 1.28%, about 1.29%, or about 1.3% Si. All percentages are expressed in wt. %.

In some examples, the alloy described herein includes iron (Fe) in an amount up to about 0.2% (e.g., from about 0.05% to about 0.17% or from about 0.12% to about 0.17%) based on the total weight of the alloy. For example, the alloy can include about 0.01%, about 0.02%, about 0.03%, about 0.04%, about 0.05%, about 0.06%, about 0.07%, about 0.08%, about 0.09%, about 0.1%, about 0.11%, about 0.12%, about 0.13%, about 0.14%, about 0.15%, about 0.16%, about 0.17%, about 0.18%, about 0.19%, or about 0.2% Fe. In some cases, Fe is not present in the alloy (i.e., 0%). All percentages are expressed in wt. %.

In some examples, the alloy described herein includes manganese (Mn) in an amount up to about 0.5% (e.g., from about 0.05% to about 0.3% or from about 0.05% to about 0.2%) based on the total weight of the alloy. For example, the alloy can include about 0.01%, about 0.02%, about 0.03%, about 0.04%, about 0.05%, about 0.06%, about 0.07%, about 0.08%, about 0.09%, about 0.1%, about 0.11%, about 0.12%, about 0.13%, about 0.14%, about 0.15%, about 0.16%, about 0.17%, about 0.18%, about 0.19%, about 0.2%, about 0.21%, about 0.22%, about 0.23%, about 0.24%, about 0.25%, about 0.26%, about 0.27%, about 0.28%, about 0.29%, about 0.3%, about 0.31%, about 0.32%, about 0.33%, about 0.34%, about 0.35%, about 0.36%, about 0.37%, about 0.38%, about 0.39%, about 0.4%, about 0.41%, about 0.42%, about 0.43%, about 0.44%, about 0.45%, about 0.46%, about 0.47%, about 0.48%, about 0.49%, or about 0.5% Mn. In some cases, Mn is not present in the alloy (i.e., 0%). All percentages are expressed in wt. %.

In some examples, the disclosed alloy includes magnesium (Mg) in an amount from about 1.0% to about 2.5% (e.g., from about 1.25% to about 2.25% or from about 1.5% to about 2.25%) based on the total weight of the alloy. For example, the alloy can include about 1.0%, about 1.01%, about 1.02%, about 1.03%, about 1.04%, about 1.05%, about 1.06%, about 1.07%, about 1.08%, about 1.09%, about 1.1%, about 1.11%, about 1.12%, about 1.13%, about 1.14%, about 1.15%, about 1.16%, about 1.17%, about 1.18%, about 1.19%, about 1.2%, about 1.21%, about 1.22%, about 1.23%, about 1.24%, about 1.25%, about 1.26%, about 1.27%, about 1.28%, about 1.29%, about 1.3%, about 1.31%, about 1.32%, about 1.33%, about 1.34%, about 1.35%, about 1.36%, about 1.37%, about 1.38%, about 1.39%, about 1.4%, about 1.41%, about 1.42%, about 1.43%, about 1.44%, about 1.45%, about 1.46%, about 1.47%, about 1.48%, about 1.49%, about 1.5%, about 1.51%, about 1.52%, about 1.53%, about 1.54%, about 1.55%, about 1.56%, about 1.57%, about 1.58%, about 1.59%, about 1.6%, about 1.61%, about 1.62%, about 1.63%, about 1.64%, about 1.65%, about 1.66%, about 1.67%, about 1.68%, about 1.69%, about 1.7%, about 1.71%, about 1.72%, about 1.73%, about 1.74%, about 1.75%, about 1.76%, about 1.77%, about 1.78%, about 1.79%, about 1.8%, about 1.81%, about 1.82%, about 1.83%, about 1.84%, about 1.85%, about 1.86%, about 1.87%, about 1.88%, about 1.89%, about 1.9%, about 1.91%, about 1.92%, about 1.93%, about 1.94%, about 1.95%, about 1.96%, about 1.97%, about 1.98%, about 1.99%, about 2.0%, about 2.01%, about 2.02%, about 2.03%, about 2.04%, about 2.05%, about 2.06%, about 2.07%, about 2.08%, about 2.09%, about 2.1%, about 2.11%, about 2.12%, about 2.13%, about 2.14%, about 2.15%, about 2.16%, about 2.17%, about 2.18%, about 2.19%, about 2.2%, about 2.21%, about 2.22%, about 2.23%, about 2.24%, about 2.25%, about 2.26%, about 2.27%, about 2.28%, about 2.29%, about 2.3%, about 2.31%, about 2.32%, about 2.33%, about 2.34%, about 2.35%, about 2.36%, about 2.37%, about 2.38%, about 2.39%, about 2.4%, about 2.41%, about 2.42%, about 2.43%, about 2.44%, about 2.45%, about 2.46%, about 2.47%, about 2.48%, about 2.49%, or about 2.5% Mg. All percentages are expressed in wt. %.

In some examples, the disclosed alloy includes copper (Cu) in an amount from about 0.5% to about 1.5% (e.g., from about 0.6% to about 1.0% or from about 0.6% to about 0.9%) based on the total weight of the alloy. For example, the alloy can include about 0.5%, about 0.51%, about 0.52%, about 0.53%, about 0.54%, about 0.55%, about 0.56%, about 0.57%, about 0.58%, about 0.59%, about 0.6%, about 0.61%, about 0.62%, about 0.63%, about 0.64%, about 0.65%, about 0.66%, about 0.67%, about 0.68%, about 0.69%, about 0.7%, about 0.71%, about 0.72%, about 0.73%, about 0.74%, about 0.75%, about 0.76%, about 0.77%, about 0.78%, about 0.79%, about 0.8%, about 0.81%, about 0.82%, about 0.83%, about 0.84%, about 0.85%, about 0.86%, about 0.87%, about 0.88%, about 0.89%, about 0.9%, about 0.91%, about 0.92%, about 0.93%, about 0.94%, about 0.95%, about 0.96%, about 0.97%, about 0.98%, about 0.99%, about 1.0%, about 1.01%, about 1.02%, about 1.03%, about 1.04%, about 1.05%, about 1.06%, about 1.07%, about 1.08%, about 1.09%, about 1.1%, about 1.11%, about 1.12%, about 1.13%, about 1.14%, about 1.15%, about 1.16%, about 1.17%, about 1.18%, about 1.19%, about 1.2%, about 1.21%, about 1.22%, about 1.23%, about 1.24%, about 1.25%, about 1.26%, about 1.27%, about 1.28%, about 1.29%, about 1.3%, about 1.31%, about 1.32%, about 1.33%, about 1.34%, about 1.35%, about 1.36%, about 1.37%, about 1.38%, about 1.39%, about 1.4%, about 1.41%, about 1.42%, about 1.43%, about 1.44%, about 1.45%, about 1.46%, about 1.47%, about 1.48%, about 1.49%, or about 1.5% Cu. All percentages are expressed in wt. %.

In some examples, the alloy described herein includes zinc (Zn) in an amount up to about 3.0% (e.g., from about 1.0% to about 3.0%, from about 1.5% to about 3.0%, or from about 2.0% to about 3.0%) based on the total weight of the alloy. For example, the alloy can include about 0.01%, about 0.02%, about 0.03%, about 0.04%, about 0.05%, about 0.06%, about 0.07%, about 0.08%, about 0.09%, about 0.1%, about 0.11%, about 0.12%, about 0.13%, about 0.14%, about 0.15%, about 0.16%, about 0.17%, about 0.18%, about 0.19%, about 0.2%, about 0.21%, about 0.22%, about 0.23%, about 0.24%, about 0.25%, about 0.26%, about 0.27%, about 0.28%, about 0.29%, about 0.3%, about 0.31%, about 0.32%, about 0.33%, about 0.34%, about 0.35%, about 0.36%, about 0.37%, about 0.38%, about 0.39%, about 0.4%, about 0.41%, about 0.42%, about 0.43%, about 0.44%, about 0.45%, about 0.46%, about 0.47%, about 0.48%, about 0.49%, about 0.5%, about 0.51%, about 0.52%, about 0.53%, about 0.54%, about 0.55%, about 0.56%, about 0.57%, about 0.58%, about 0.59%, about 0.6%, about 0.61%, about 0.62%, about 0.63%, about 0.64%, about 0.65%, about 0.66%, about 0.67%, about 0.68%, about 0.69%, about 0.7%, about 0.71%, about 0.72%, about 0.73%, about 0.74%, about 0.75%, about 0.76%, about 0.77%, about 0.78%, about 0.79%, about 0.8%, about 0.81%, about 0.82%, about 0.83%, about 0.84%, about 0.85%, about 0.86%, about 0.87%, about 0.88%, about 0.89%, about 0.9%, about 0.91%, about 0.92%, about 0.93%, about 0.94%, about 0.95%, about 0.96%, about 0.97%, about 0.98%, about 0.99%, about 1.0%, about 1.01%, about 1.02%, about 1.03%, about 1.04%, about 1.05%, about 1.06%, about 1.07%, about 1.08%, about 1.09%, about 1.1%, about 1.11%, about 1.12%, about 1.13%, about 1.14%, about 1.15%, about 1.16%, about 1.17%, about 1.18%, about 1.19%, about 1.2%, about 1.21%, about 1.22%, about 1.23%, about 1.24%, about 1.25%, about 1.26%, about 1.27%, about 1.28%, about 1.29%, about 1.3%, about 1.31%, about 1.32%, about 1.33%, about 1.34%, about 1.35%, about 1.36%, about 1.37%, about 1.38%, about 1.39%, about 1.4%, about 1.41%, about 1.42%, about 1.43%, about 1.44%, about 1.45%, about 1.46%, about 1.47%, about 1.48%, about 1.49%, about 1.5%, about 1.51%, about 1.52%, about 1.53%, about 1.54%, about 1.55%, about 1.56%, about 1.57%, about 1.58%, about 1.59%, about 1.6%, about 1.61%, about 1.62%, about 1.63%, about 1.64%, about 1.65%, about 1.66%, about 1.67%, about 1.68%, about 1.69%, about 1.7%, about 1.71%, about 1.72%, about 1.73%, about 1.74%, about 1.75%, about 1.76%, about 1.77%, about 1.78%, about 1.79%, about 1.8%, about 1.81%, about 1.82%, about 1.83%, about 1.84%, about 1.85%, about 1.86%, about 1.87%, about 1.88%, about 1.89%, about 1.9%, about 1.91%, about 1.92%, about 1.93%, about 1.94%, about 1.95%, about 1.96%, about 1.97%, about 1.98%, about 1.99%, about 2.0%, about 2.01%, about 2.02%, about 2.03%, about 2.04%, about 2.05%, about 2.06%, about 2.07%, about 2.08%, about 2.09%, about 2.1%, about 2.11%, about 2.12%, about 2.13%, about 2.14%, about 2.15%, about 2.16%, about 2.17%, about 2.18%, about 2.19%, about 2.2%, about 2.21%, about 2.22%, about 2.23%, about 2.24%, about 2.25%, about 2.26%, about 2.27%, about 2.28%, about 2.29%, about 2.3%, about 2.31%, about 2.32%, about 2.33%, about 2.34%, about 2.35%, about 2.36%, about 2.37%, about 2.38%, about 2.39%, about 2.4%, about 2.41%, about 2.42%, about 2.43%, about 2.44%, about 2.45%, about 2.46%, about 2.47%, about 2.48%, about 2.49%, about 2.5%, about 2.51%, about 2.52%, about 2.53%, about 2.54%, about 2.55%, about 2.56%, about 2.57%, about 2.58%, about 2.59%, about 2.6%, about 2.61%, about 2.62%, about 2.63%, about 2.64%, about 2.65%, about 2.66%, about 2.67%, about 2.68%, about 2.69%, about 2.7%, about 2.71%, about 2.72%, about 2.73%, about 2.74%, about 2.75%, about 2.76%, about 2.77%, about 2.78%, about 2.79%, about 2.8%, about 2.81%, about 2.82%, about 2.83%, about 2.84%, about 2.85%, about 2.86%, about 2.87%, about 2.88%, about 2.89%, about 2.9%, about 2.91%, about 2.92%, about 2.93%, about 2.94%, about 2.95%, about 2.96%, about 2.97%, about 2.98%, about 2.99%, or about 3.0% Zn. In some cases, Zn is not present in the alloy (i.e., 0%). All percentages are expressed in wt. %.

Optionally, zirconium (Zr) can be included in the alloys described herein. In some examples, the alloy includes Zr in an amount up to about 0.15% (e.g., from about 0.07% to about 0.15%, from about 0.09% to about 0.12%, or from about 0.08% to about 0.11%) based on the total weight of the alloy. For example, the alloy can include about 0.01%, about 0.02%, about 0.03%, about 0.04%, about 0.05%, about 0.06%, about 0.07%, about 0.08%, about 0.09%, about 0.1%, about 0.11%, about 0.12%, about 0.13%, about 0.14%, or about 0.15% Zr. In some examples, Zr is not present in the alloys (i.e., 0%). All percentages are expressed in wt. %. In certain aspects, Zr is added to the above-described compositions to form $(Al,Si)_3Zr$ dispersoids ($DO_{22}/DO_{23}$ dispersoids) and/or $Al_3Zr$ dispersoids ($Ll_2$ dispersoids).

Optionally, the alloy compositions can further include other minor elements, sometimes referred to as impurities, in amounts of about 0.05% or below, 0.04% or below, 0.03% or below, 0.02% or below, or 0.01% or below each. These impurities may include, but are not limited to, Ga, V, Ni, Sc, Ag, B, Bi, Li, Pb, Sn, Ca, Cr, Ti, Hf, Sr, or combinations thereof. Accordingly, Ga, V, Ni, Sc, Ag, B, Bi, Li, Pb, Sn, Ca, Cr, Ti, Hf, or Sr may be present in an alloy in amounts of 0.05% or below, 0.04% or below, 0.03% or below, 0.02% or below, or 0.01% or below. In certain aspects, the sum of all impurities does not exceed 0.15% (e.g., 0.1%). All percentages are expressed in wt. %. In certain aspects, the remaining percentage of the alloy is aluminum.

Suitable exemplary alloys can include, for example, 1.0% Si, 2.0%-2.25% Mg, 0.6%-0.7% Cu, 2.5%-3.0% Zn, 0.07-0.10% Mn, 0.14-0.17% Fe, 0.09-0.10% Zr, and up to 0.15% total impurities, with the remainder Al. In some cases, suitable exemplary alloys can include 0.55%-0.65% Si, 1.5% Mg, 0.7%-0.8% Cu, 1.55% Zn, 0.14-0.15% Mn, 0.16-0.18% Fe, and up to 0.15% total impurities, with the remainder Al. In some cases, suitable exemplary alloys can include 0.65% Si, 1.5% Mg, 1.0% Cu, 2.0%-3.0% Zn, 0.14-0.15% Mn, 0.17% Fe, and up to 0.15% total impurities, with the remainder Al.

Alloy Microstructure and Properties

In certain aspects, the Cu, Mg, and Si ratios and Zn content are controlled to enhance corrosion resistance, strength, and formability. The Zn content can control corrosion morphology as described below, by, for example, inducing pitting corrosion and suppressing intergranular corrosion (IGC).

In some examples, a ratio of Mg to Si (also referred to herein as Mg/Si ratio) can be from about 1.5:1 to about 3.5:1 (e.g., from about 1.75:1 to about 3.0:1 or from about 2.0:1 to about 3.0:1). For example, the Mg/Si ratio can be about 1.5:1, about 1.6:1, about 1.7:1, about 1.8:1, about 1.9:1, about 2.0:1, about 2.1:1, about 2.2:1, about 2.3:1, about 2.4:1, about 2.5:1, about 2.6:1, about 2.7:1, about 2.8:1, about 2.9:1, about 3.0:1, about 3.1:1, about 3.2:1, about 3.3:1, about 3.4:1, about 3.5:1, about 3.6:1, about 3.7:1, about 3.8:1, about 3.9:1, or about 4.0:1. In some non-limiting examples, an aluminum alloy having an Mg/Si ratio of about 1.5:1 to about 3.5:1 (e.g., from about 2.0:1 to about 3.0:1) can exhibit high strength and increased formability.

In some non-limiting examples, an aluminum alloy having an Mg/Si ratio of about 2.0:1-3.0:1 and a Zn content of about 2.5 wt. %-about 3.0 wt. % can exhibit suppression of IGC typically observed in aluminum alloys having Mg and Si as predominant alloying elements, and instead can induce pitting corrosion. In some cases, pitting corrosion can be favorable over IGC due to a limited attack depth, as IGC can occur along grain boundaries and propagate deeper into the aluminum alloy than pitting corrosion. In some non-limiting examples, a ratio of Zn to the ratio of Mg/Si (i.e., the Zn/(Mg/Si) ratio) can be from about 0.75:1 to about 1.4:1 (e.g., from about 0.8:1 to about 1.1:1). For example, the Zn/(Mg/Si) ratio can be about 0.75:1, about 0.8:1, about 0.85:1, about 0.9:1, about 0.95:1, about 1.0:1, about 1.05:1, about 1.1:1, about 1.15:1, about 1.2:1, about 1.25:1, about 1.3:1, about 1.35:1, or about 1.4:1.

In some still further non-limiting examples, a ratio of Cu to the Zn/(Mg/Si) ratio (i.e., the Cu/[Zn/(Mg/Si)] ratio) can be from about 0.7:1 to about 1.4:1 (e.g., the Cu/[Zn/(Mg/Si)] ratio can be about 0.8:1 to about 1.1:1). For example, the ratio of Cu/[Zn/(Mg/Si)] can be about 0.7:1, about 0.75:1, about 0.8:1, about 0.85:1, about 0.9:1, about 0.95:1, about 1.0:1, about 1.05:1, about 1.1:1, about 1.15:1, about 1.2:1, about 1.25:1, about 1.3:1, about 1.35:1, or about 1.4:1. In some non-limiting examples, the ratio of Cu/[Zn/(Mg/Si)] can provide high strength, high deformability, and high corrosion resistance.

In certain aspects, Cu, Si, and Mg can form precipitates in the alloy to result in an alloy with higher strength and enhanced corrosion resistance. These precipitates can form during the aging processes, after solution heat treatment. The Mg and Cu content can provide precipitation of an M/η phase or M phase (e.g., $MgZn_2$/$Mg(Zn,Cu)_2$), resulting in precipitates that can increase strength in the aluminum alloy. During the precipitation process, metastable Guinier Preston (GP) zones can form, which in turn transfer to β" needle shape precipitates (e.g., magnesium silicide, $Mg_2Si$) that contribute to precipitation strengthening of the disclosed alloys. In certain aspects, addition of Cu leads to the formation of lathe-shaped L phase precipitation (e.g., $Al_4Mg_8Si_7Cu_2$), which is a precursor of Q' precipitate phase formation and which further contributes to strength.

In some examples, the M phase precipitates, including $MgZn_2$ and/or $Mg(Zn,Cu)_2$, can be present in the aluminum alloy in an average amount of at least about 300,000,000 particles per square millimeter ($mm^2$). For example, the M phase precipitates can be present in an amount of at least about 310,000,000 particles per $mm^2$, at least about 320,000,000 particles per $mm^2$, at least about 330,000,000 particles per $mm^2$, at least about 340,000,000 particles per $mm^2$, at least about 350,000,000 particles per $mm^2$, at least about 360,000,000 particles per $mm^2$, at least about 370,000,000 particles per $mm^2$, at least about 380,000,000 particles per $mm^2$, at least about 390,000,000 particles per $mm^2$, or at least about 400,000,000 particles per $mm^2$.

In some examples, the L phase precipitates, including $Al_4Mg_8Si_7Cu_2$, can be present in the aluminum alloy in an average amount of at least about 600,000,000 particles per square millimeter ($mm^2$). For example, the L phase precipitates can be present in an amount of at least about 610,000,000 particles per $mm^2$, at least about 620,000,000 particles per $mm^2$, at least about 630,000,000 particles per $mm^2$, at least about 640,000,000 particles per $mm^2$, at least about 650,000,000 particles per $mm^2$, at least about 660,000,000 particles per $mm^2$, at least about 670,000,000 particles per $mm^2$, at least about 680,000,000 particles per $mm^2$, at least about 690,000,000 particles per $mm^2$, or at least about 700,000,000 particles per $mm^2$.

In some examples, the β" phase precipitates, including $Mg_2Si$, can be present in the aluminum alloy in an average amount of at least about 600,000,000 particles per square millimeter ($mm^2$). For example, the β" phase precipitates can be present in an amount of at least about 610,000,000 particles per $mm^2$, at least about 620,000,000 particles per $mm^2$, at least about 630,000,000 particles per $mm^2$, at least about 640,000,000 particles per $mm^2$, at least about 650,000,000 particles per $mm^2$, at least about 660,000,000 particles per $mm^2$, at least about 670,000,000 particles per $mm^2$, at least about 680,000,000 particles per $mm^2$, at least about 690,000,000 particles per $mm^2$, at least about 700,000,000 particles per $mm^2$, at least about 710,000,000 particles per $mm^2$, at least about 720,000,000 particles per $mm^2$, at least about 730,000,000 particles per $mm^2$, at least about 740,000,000 particles per $mm^2$, or at least about 750,000,000 particles per $mm^2$.

In some examples, a ratio of the β" phase precipitates (e.g., $Mg_2Si$) to the L phase precipitates (e.g., $Al_4Mg_8Si_7Cu_2$) can be from about 1:1 to about 1.5:1 (e.g., from about 1.1:1 to about 1.4:1). For example, the ratio of the β" phase precipitates to the L phase precipitates can be about 1:1, about 1.1:1, about 1.2:1, about 1.3:1, about 1.4:1, or about 1.5:1.

In some examples, a ratio of the β" phase precipitates (e.g., $Mg_2Si$) to the M phase precipitates (e.g., $MgZn_2$ and/or $Mg(Zn,Cu)_2$) can be from about 1.5:1 to about 3:1 (e.g., from about 1.6:1 to about 2.8:1 or from about 2.0:1 to about 2.5:1). For example, the ratio of the β" phase precipitates to the M phase precipitates can be about 1.5:1, about 1.6:1, about 1.7:1, about 1.8:1, about 1.9:1, about 2.0:1, about 2.1:1, about 2.2:1, about 2.3:1, about 2.4:1, about 2.5:1, about 2.6:1, about 2.7:1, about 2.8:1, about 2.9:1, or about 3.0:1.

In some examples, a ratio of the L phase precipitates (e.g., $Al_4Mg_8Si_7Cu_2$) to the M phase precipitates (e.g., $MgZn_2$ and/or $Mg(Zn,Cu)_2$) can be from about 1.5:1 to about 3:1 (e.g., from about 1.6:1 to about 2.8:1 or from about 2.0:1 to about 2.5:1). For example, the ratio of the L phase precipitates to the M phase precipitates can be about 1.5:1, about 1.6:1, about 1.7:1, about 1.8:1, about 1.9:1, about 2.0:1, about 2.1:1, about 2.2:1, about 2.3:1, about 2.4:1, about 2.5:1, about 2.6:1, about 2.7:1, about 2.8:1, about 2.9:1, or about 3.0:1.

The alloys described herein display exceptional mechanical properties, as further provided below. The mechanical properties of the aluminum alloys can be further controlled by various aging conditions depending on the desired use. As one example, the alloy can be produced (or provided) in the T4 temper or the T6 temper. T4 aluminum alloy articles that are solution heat-treated and naturally aged can be provided. These T4 aluminum alloy articles can optionally be subjected to additional aging treatment(s) to meet strength requirements upon receipt. For example, aluminum alloy articles can be delivered in other tempers, such as the T6 temper, by subjecting the T4 alloy material to the appropriate aging treatment as described herein or otherwise known to those of skill in the art. Exemplary properties in exemplary tempers are provided below.

In certain aspects, the aluminum alloy can have a yield strength of at least about 340 MPa in the T6 temper. In non-limiting examples, the yield strength can be at least about 350 MPa, at least about 360 MPa, or at least about 370 MPa. In some cases, the yield strength is from about 340 MPa to about 400 MPa. For example, the yield strength can be from about 350 MPa to about 390 MPa or from about 360 MPa to about 380 MPa.

In certain aspects, the aluminum alloy can have an ultimate tensile strength of at least about 400 MPa in the T6 temper. In non-limiting examples, the ultimate tensile strength can be at least about 410 MPa, at least about 420 MPa, or at least about 430 MPa. In some cases, the ultimate tensile strength is from about 400 MPa to about 450 MPa.

For example, the ultimate tensile strength can be from about 410 MPa to about 440 MPa or from about 415 MPa to about 435 MPa.

In certain aspects, the aluminum alloy has sufficient ductility or toughness to meet a 90° bendability of 1.0 or less in the T4 temper (e.g., 0.5 or less). In certain examples, the r/t bendability ratio is about 1.0 or less, about 0.9 or less, about 0.8 or less, about 0.7 or less, about 0.6 or less, about 0.5 or less, about 0.4 or less, about 0.3 or less, about 0.2 or less, or about 0.1 or less, where r is the radius of the tool (die) used and t is the thickness of the material.

In certain aspects, the aluminum alloy exhibits a uniform elongation of greater than or equal to 20% in the T4 temper and a total elongation of greater than or equal to 30% in the T4 temper. In certain aspects, the alloys exhibit a uniform elongation of greater than or equal to 22% and a total elongation of greater than or equal to 35%. For example, the alloys can exhibit a uniform elongation of 20% or more, 21% or more, 22% or more, 23% or more, 24% or more, 25% or more, 26% or more, 27% or more, or 28% or more. The alloys can exhibit a total elongation of 30% or more, 31% or more, 32% or more, 33% or more, 34% or more, 35% or more, 36% or more, 37% or more, 38% or more, 39% or more, or 40% or more.

In certain aspects, the aluminum alloy exhibits a suitable resistance to IGC, as measured by ISO 11846B. For example, the pitting in the aluminum alloys can be completely suppressed or improved, such that the average intergranular corrosion pit depth of an alloy in the T6 temper is less than 100 μm. For example, the average intergranular corrosion pit depth can be less than 90 μm, less than 80 μm, less than 70 μm, less than 60 μm, less than 50 μm, or less than 40 μm.

Methods of Preparing the Aluminum Alloys

In certain aspects, the disclosed alloy composition is a product of a disclosed method. Without intending to limit the disclosure, aluminum alloy properties are partially determined by the formation of microstructures during the alloy's preparation. In certain aspects, the method of preparation for an alloy composition may influence or even determine whether the alloy will have properties adequate for a desired application.

Casting

The alloy described herein can be cast using a casting method. In some non-limiting examples, the aluminum alloy as described herein can be cast from molten aluminum alloy that includes scrap alloys (e.g., from an AA6xxx series aluminum alloy scrap, an AA7xxx series aluminum alloy scrap, or a combination of these). The casting process can include a Direct Chill (DC) casting process. Optionally, the ingot can be scalped before downstream processing. Optionally, the casting process can include a continuous casting (CC) process. The cast aluminum alloy can then be subjected to further processing steps. For example, the processing methods as described herein can include the steps of homogenizing, hot rolling, solution heat treating, and quenching. In some cases, the processing methods can also include a pre-aging step and/or an artificial aging step.

Homogenization

The homogenization step can include heating the ingot prepared from an alloy composition described herein to attain a peak metal temperature (PMT) of about, or at least about, 500° C. (e.g., at least 520° C., at least 530° C., at least 540° C., at least 550° C., at least 560° C., at least 570° C., or at least 580° C.). For example, the ingot can be heated to a temperature of from about 500° C. to about 600° C., from about 520° C. to about 580° C., from about 530° C. to about 575° C., from about 535° C. to about 570° C., from about 540° C. to about 565° C., from about 545° C. to about 560° C., from about 530° C. to about 560° C., or from about 550° C. to about 580° C. In some cases, the heating rate to the PMT can be about 70° C./hour or less, 60° C./hour or less, 50° C./hour or less, 40° C./hour or less, 30° C./hour or less, 25° C./hour or less, 20° C./hour or less, or 15° C./hour or less. In other cases, the heating rate to the PMT can be from about 10° C./min to about 100° C./min (e.g., about 10° C./min to about 90° C./min, about 10° C./min to about 70° C./min, about 10° C./min to about 60° C./min, from about 20° C./min to about 90° C./min, from about 30° C./min to about 80° C./min, from about 40° C./min to about 70° C./min, or from about 50° C./min to about 60° C./min).

The ingot is then allowed to soak (i.e., held at the indicated temperature) for a period of time. According to one non-limiting example, the ingot is allowed to soak for up to about 6 hours (e.g., from about 30 minutes to about 6 hours, inclusively). For example, the ingot can be soaked at a temperature of at least 500° C. for 30 minutes, 1 hour, 2 hours, 3 hours, 4 hours, 5 hours, or 6 hours, or anywhere in between.

Hot Rolling

Following the homogenization step, a hot rolling step can be performed to form a hot band. In certain cases, the ingots are laid down and hot-rolled with an exit temperature ranging from about 230° C. to about 300° C. (e.g., from about 250° C. to about 300° C.). For example, the hot roll exit temperature can be about 230° C., about 235° C., about 240° C., about 245° C., about 250° C., about 255° C., about 260° C., about 265° C., about 270° C., about 275° C., about 280° C., about 285° C., about 290° C., about 295° C., or about 300° C.

In certain cases, the ingot can be hot rolled to an about 4 mm to about 15 mm thick gauge (e.g., from about 5 mm to about 12 mm thick gauge). For example, the ingot can be hot rolled to an about 4 mm thick gauge, about 5 mm thick gauge, about 6 mm thick gauge, about 7 mm thick gauge, about 8 mm thick gauge, about 9 mm thick gauge, about 10 mm thick gauge, about 11 mm thick gauge, about 12 mm thick gauge, about 13 mm thick gauge, about 14 mm thick gauge, or about 15 mm thick gauge. In certain cases, the ingot can be hot rolled to a gauge greater than 15 mm thick (e.g., a plate gauge). In other cases, the ingot can be hot rolled to a gauge less than 4 mm (e.g., a sheet gauge).

Solution Heat Treating

Following the hot rolling step, the hot band can be cooled by air and then solutionized in a solution heat treatment step. The solution heat treating can include heating the final gauge aluminum alloy from room temperature to a temperature of from about 520° C. to about 590° C. (e.g., from about 520° C. to about 580° C., from about 530° C. to about 570° C., from about 545° C. to about 575° C., from about 550° C. to about 570° C., from about 555° C. to about 565° C., from about 540° C. to about 560° C., from about 560° C. to about 580° C., or from about 550° C. to about 575° C.). The final gauge aluminum alloy can soak at the temperature for a period of time. In certain aspects, the final gauge aluminum alloy is allowed to soak for up to approximately 2 hours (e.g., from about 10 seconds to about 120 minutes, inclusively). For example, the final gauge aluminum alloy can be soaked at the temperature of from about 525° C. to about 590° C. for 20 seconds, 25 seconds, 30 seconds, 35 seconds, 40 seconds, 45 seconds, 50 seconds, 55 seconds, 60 seconds, 65 seconds, 70 seconds, 75 seconds, 80 seconds, 85 seconds, 90 seconds, 95 seconds, 100 seconds, 105 seconds, 110 seconds, 115 seconds, 120 seconds, 125 seconds, 130 seconds, 135 seconds, 140 seconds, 145 seconds, 150 seconds, 5 minutes, 10 minutes, 15 minutes, 20 minutes, 25 minutes, 30 minutes, 35 minutes, 40 minutes, 45 minutes, 50 minutes, 55 minutes, 60 minutes, 65 minutes, 70 minutes, 75 minutes, 80 minutes, 85 minutes, 90 minutes, 95 minutes, 100 minutes, 105 minutes, 110 minutes, 115 minutes, or 120 minutes, or anywhere in between.

Quenching

In certain aspects, the final gauge aluminum alloy can then be cooled to a temperature of about 35° C. at a quench speed that can vary between about 50° C./s to 400° C./s in a quenching step that is based on the selected gauge. For example, the quench rate can be from about 50° C./s to about 375° C./s, from about 60° C./s to about 375° C./s, from about 70° C./s to about 350° C./s, from about 80° C./s to about 325° C./s, from about 90° C./s to about 300° C./s, from about 100° C./s to about 275° C./s, from about 125° C./s to about 250° C./s, from about 150° C./s to about 225° C./s, or from about 175° C./s to about 200° C./s.

In the quenching step, the final gauge aluminum alloy is rapidly quenched with a liquid (e.g., water) and/or gas or another selected quench medium. In certain aspects, the final gauge aluminum alloy can be rapidly quenched with water.

Pre-Aging

Optionally, a pre-aging step can be performed. The pre-aging step can include heating the final gauge aluminum alloy after the quenching step to a temperature of from about 100° C. to about 160° C. (e.g., from about 105° C. to about 155° C., about 110° C. to about 150° C., about 115° C. to about 145° C., about 120° C. to about 140° C., or about 125° C. to about 135° C.). In certain aspects, the aluminum alloy sheet, plate, or shate is allowed to soak for up to approximately three hours (e.g., for up to about 10 minutes, for up to about 20 minutes, for up to about 30 minutes, for up to about 40 minutes, for up to about 45 minutes, for up to about 60 minutes, for up to about 90 minutes, for up to about two hours, or for up to about three hours).

Aging

The final gauge aluminum alloy can be naturally aged or artificially aged. In some examples, the final gauge aluminum alloy can be naturally aged for a period of time to result in the T4 temper. In certain aspects, the final gauge aluminum alloy in the T4 temper can be artificially aged (AA) at about 180° C. to 225° C. (e.g., 185° C., 190° C., 195° C., 200° C., 205° C., 210° C., 215° C., 220° C., or 225° C.) for a period of time. Optionally, the final gauge aluminum alloy can be artificially aged for a period from about 15 minutes to about 8 hours (e.g., 15 minutes, 30 minutes, 1 hour, 2 hours, 3 hours, 4 hours, 5 hours, 6 hours, 7 hours, or 8 hours or anywhere in between) to result in the T6 temper.

Methods of Using

The alloys and methods described herein can be used in automotive, electronics, and transportation applications, such as commercial vehicle, aircraft, or railway applications, or other applications. For example, the alloys could be used for chassis, cross-member, and intra-chassis components (encompassing, but not limited to, all components between the two C channels in a commercial vehicle chassis) to gain strength, serving as a full or partial replacement of high-strength steels. In certain examples, the alloys can be used in T4 and T6 tempers.

In certain aspects, the alloys and methods can be used to prepare motor vehicle body part products. For example, the disclosed alloys and methods can be used to prepare automobile body parts, such as bumpers, side beams, roof beams, cross beams, pillar reinforcements (e.g., A-pillars, B-pillars, and C-pillars), inner panels, side panels, floor panels, tunnels, structure panels, reinforcement panels, inner hoods, or trunk lid panels. The disclosed aluminum alloys and methods can also be used in aircraft or railway vehicle applications, to prepare, for example, external and internal panels. In certain aspects, the disclosed alloys can be used for other specialties applications, such as automotive battery plates/shates.

The described alloys and methods can also be used to prepare housings for electronic devices, including mobile phones and tablet computers. For example, the alloys can be used to prepare housings for the outer casing of mobile phones (e.g., smart phones) and tablet bottom chassis, with or without anodizing. The alloys can also be used to prepare other consumer electronic products and product parts. Exemplary consumer electronic products include mobile phones, audio devices, video devices, cameras, laptop computers, desktop computers, tablet computers, televisions, displays, household appliances, video playback and recording devices, and the like. Exemplary consumer electronic product parts include outer housings (e.g., facades) and inner pieces for the consumer electronic products.

The following examples will serve to further illustrate the present invention without, however, constituting any limitation thereof. On the contrary, it is to be clearly understood that resort may be had to various embodiments, modifications, and equivalents thereof which, after reading the description herein, may suggest themselves to those skilled in the art without departing from the spirit of the invention. During the studies described in the following examples, conventional procedures were followed, unless otherwise stated. Some of the procedures are described below for illustrative purposes.

EXAMPLES

Example 1: Aluminum Alloy Compositions

Tables 4A and 4B below summarize exemplary aluminum alloys and Table 5 provides the properties of the alloys, including yield strength (YS), intergranular corrosion pit depths (IGC), and 90° bendability (Bend).

TABLE 4A

| Alloy | Cu | Mg | Mn | Si | Zn | Fe | Zr |
|---|---|---|---|---|---|---|---|
| 1 | 0.60 | 0.9-1.2 | 0.19 | 0.9-1.1 | <0.01 | 0.16-0.19 | 0 |
| 2 | 0.80 | 1.0 | 0.17-0.19 | 1.1 | 1.5-3.0 | 0.18-0.20 | 0.006 |
| 3 | 0.6-0.7 | 2.0-2.25 | 0.07-0.10 | 1.0 | 2.5-3.0 | 0.14-0.17 | 0.09-0.10 |
| 4 | 0.7-0.8 | 1.5 | 0.14-0.15 | 0.55-0.65 | 1.55 | 0.16-0.18 | 0 |
| 5 | 1.0 | 1.5 | 0.14-0.15 | 0.63-0.67 | 2.0-3.0 | 0.17 | 0 |

All expressed in wt. %;
total impurities up to 0.15 wt. %;
remainder Al.

TABLE 4B

| Alloy | Mg/Si | Zn/(Mg/Si) | Cu/[Zn/(Mg/Si)] |
|---|---|---|---|
| 1 | 0.87-1.19 | 0 | 0 |
| 2 | 0.97-1.1 | 1.3-3.1 | 0.25-0.62 |
| 3 | 2.0-2.25 | 1.1-1.5 | 0.4-0.64 |
| 4 | 2.3-2.8 | 0.55-0.67 | 1.04-1.4 |
| 5 | 2.2-2.4 | 0.8-1.4 | 0.71-1.25 |

TABLE 5

| Alloy | YS (MPa) | IGC (μm) | Bend (90°) |
|---|---|---|---|
| 1 | 380 | 300 | Fail |
| 2 | 370 | 250 | Fail |
| 3 | 340 | 0 | Pass |
| 4 | 360 | 200 | Fail |
| 5 | 370 | 120 | Pass |

The properties of the alloys were achieved by controlling the ratios of alloying elements. Alloy 1 represents comparative AA6xxx series aluminum alloys exhibiting high strength due to $Mg_2Si$ strengthening precipitates in the aluminum alloy. Alloy 2 represents comparative aluminum alloys exhibiting improved corrosion resistance and a slight decrease in strength upon adding Zn. Alloys 1 and 2, wherein the ratio of Cu/[Zn/(Mg/Si)] does not fall in the range of from about 0.7 to about 1.4, exhibit significant IGC and failure in a 90° bend test. Alloy 3 represents exemplary aluminum alloys wherein the ratios of Cu/[Zn/(Mg/Si)] are closer to the range of from about 0.7 to about 1.4 than Alloy 2, exhibiting a decrease in strength with excellent formability and resistance to IGC. Alloy 4 represents exemplary aluminum alloys wherein the ratios of Cu/[Zn/(Mg/Si)] fall within the range of from about 0.7 to about 1.4, but the ratios of Zn/(Mg/Si) do not fall within a range of from about 0.75 to about 1.4, exhibiting significant IGC and poor formability, and increased strength when compared to Alloy 3. Alloy 5 represents exemplary aluminum alloys wherein the ratios of Mg/Si, Zn/(Mg/Si), and Cu/[Zn/(Mg/Si)] all fall within the respective ranges, exhibiting high strength, good formability, and good resistance to corrosion.

In addition, exemplary alloys were produced according to the direct chill casting methods described herein. The alloy compositions are summarized in Table 6 below:

TABLE 6

| Alloy | Si | Fe | Cu | Mn | Mg | Cr | Zn | Ti |
|---|---|---|---|---|---|---|---|---|
| A | 0.65 | 0.20 | 1.10 | 0.15 | 1.50 | 0.05 | 2.0 | 0.02 |
| B | 0.65 | 0.20 | 1.10 | 0.15 | 1.50 | 0.05 | 2.5 | 0.02 |
| C | 0.65 | 0.20 | 1.10 | 0.15 | 1.50 | 0.05 | 3.0 | 0.02 |

All expressed in wt. %;
remainder Al.

Example 2: Aluminum Alloy Microstructure

Exemplary alloys were produced by direct chill casting and processed according to the methods described herein. As described above, the Mg and Cu content can provide precipitation of an M phase (e.g., $MgZn_2$/$Mg(Zn, Cu)_2$), providing precipitates that can increase strength in the aluminum alloy. Evaluation of the M phase (e.g., $MgZn_2$) precipitates was performed as a function of Mg content in the exemplary alloys. FIG. 1 is a graph showing an increase in Mg content from 1.0 wt. % to 3.0 wt. %. Evident in the graph, a mass fraction of the M phase precipitates (i) increases proportionally with increasing Mg content from 1.0 wt. % to 1.5 wt. %, (ii) remains constant when Mg content is increased from 1.5 wt. % to 2.0 wt. %, (iii) increases proportionally with increasing Mg content from 2.0 wt. % to 2.5 wt. %, and (iv) plateaus with Mg content greater than 2.5 wt. %. The increase in M phase precipitates provides increased strength in the exemplary alloys.

Figure 2:
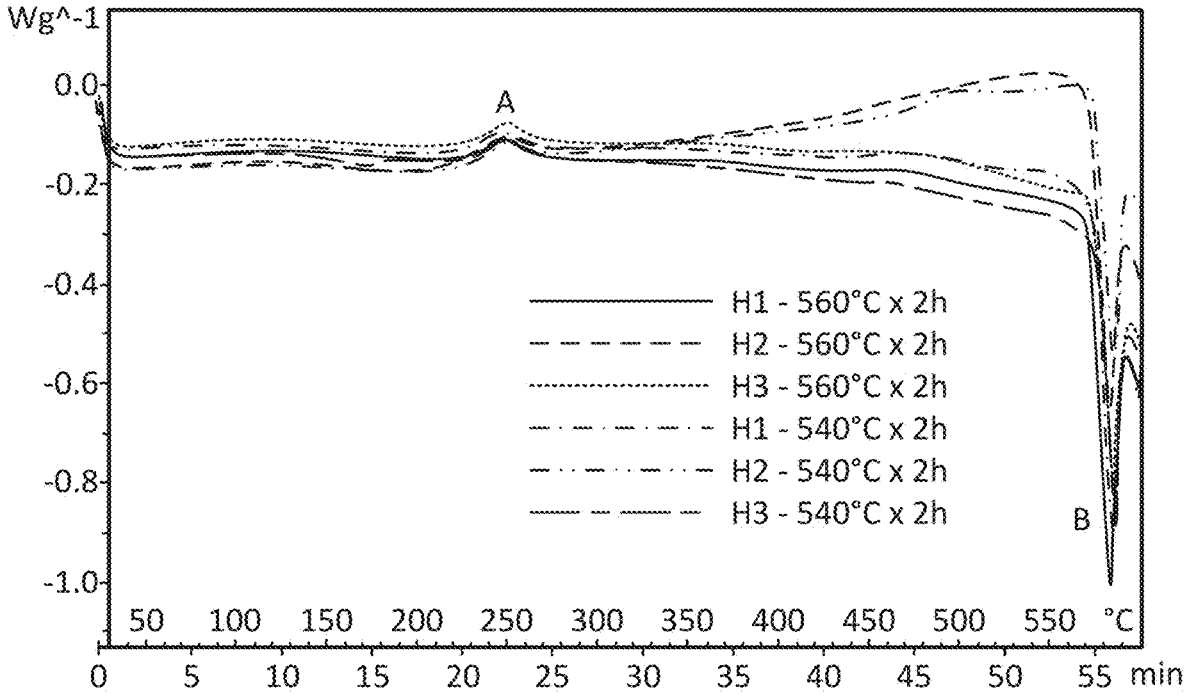
FIG. 2 is a differential scanning calorimetry graph of an aluminum alloy according to certain aspects of the present disclosure.

FIG. 2 is a graph showing differential scanning calorimetry (DSC) analysis of samples of exemplary Alloy 3 described above (referred to as "H1," "H2," and "H3"). Exothermic peak A indicates precipitate formation in the exemplary alloys and endothermic peak B indicates melting points for the exemplary Alloy 3 samples.

Figure 3:
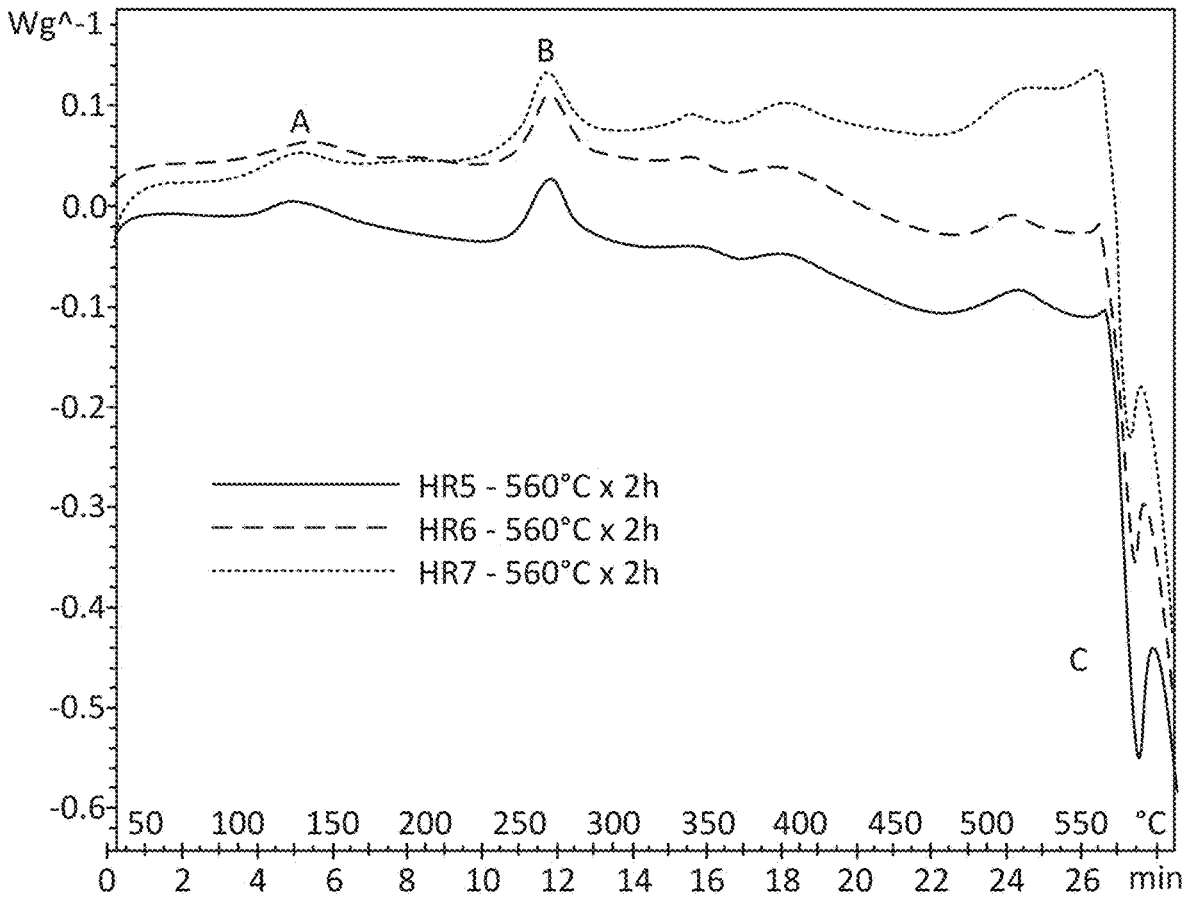
FIG. 3 is a differential scanning calorimetry graph of an aluminum alloy according to certain aspects of the present disclosure.

FIG. 3 is a graph showing DSC analysis of samples of the exemplary Alloy 5 described above (referred to as "H5," "H6," and "H7"). Exothermic peak A indicates M phase precipitates. Exothermic peak B indicates β" ($Mg_2Si$) precipitates, showing formation of the strengthening precipitates during an artificial aging step and corresponding to the increase in strength of the exemplary aluminum alloys. Endothermic peak C indicates melting points for the exemplary Alloy 5 samples.

Figure 4A:
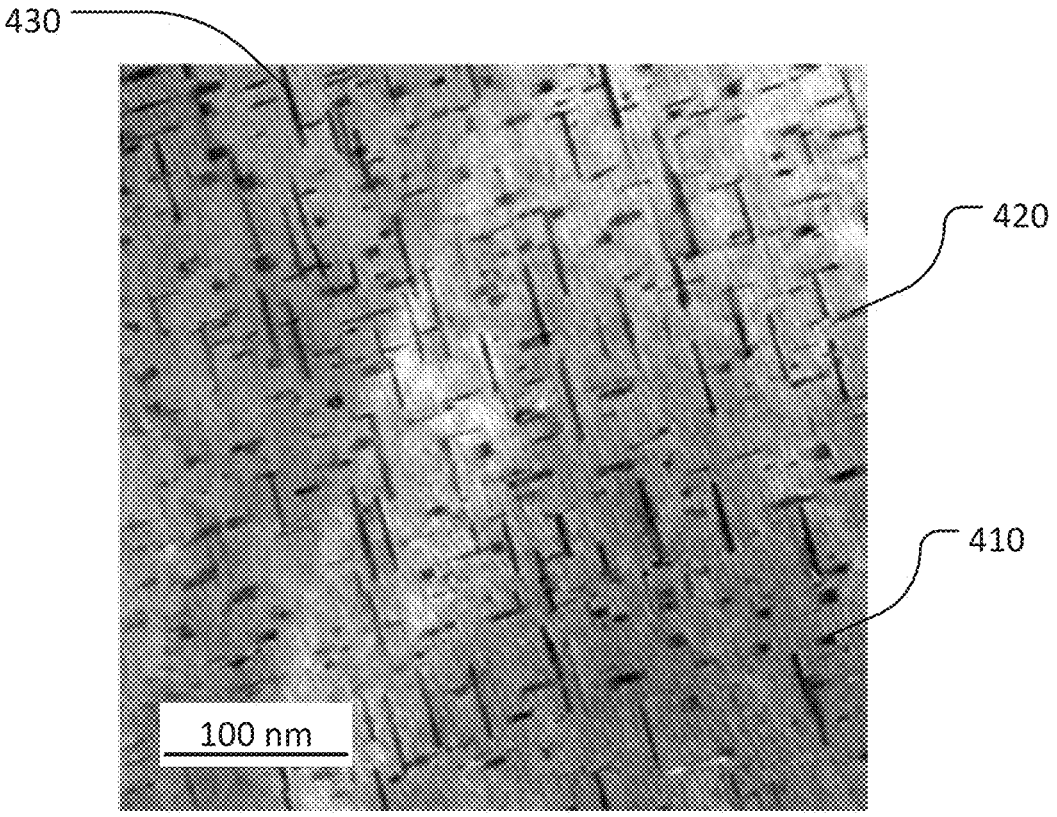
FIG. 4A is a transmission electron microscope micrograph showing precipitate types in an aluminum alloy according to certain aspects of the present disclosure.
Figure 4B:
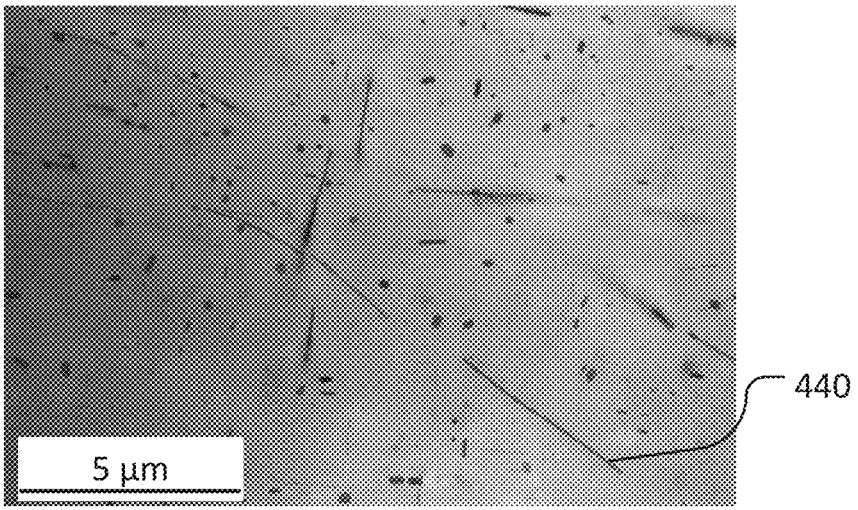
FIG. 4B is a transmission electron microscope micrograph showing precipitate types in an aluminum alloy according to certain aspects of the present disclosure.

FIG. 4A is a transmission electron microscope (TEM) micrograph showing three distinct strengthening precipitate phases, M ($MgZn_2$) 410, β" ($Mg_2Si$) 420, and L ($Al_4Mg_8Si_7Cu_2$) 430. A combination of the three precipitate phases produces a yield strength of about 370 MPa in a T6 temper for a 10 mm gauge aluminum alloy (e.g., Alloy 5). FIG. 4B is a TEM micrograph showing Zr-containing precipitate particles 440. Excess Zr in the exemplary alloys can cause coarse needle-like particles to form. The coarse, needle-like Zr-containing precipitate particles 440 can reduce formability of the exemplary alloys. Likewise, too little Zr in the exemplary alloys can fail to provide desired $Al_3Zr$ and/or $(Al,Si)_3Zr$ dispersoids.

Figure 5:
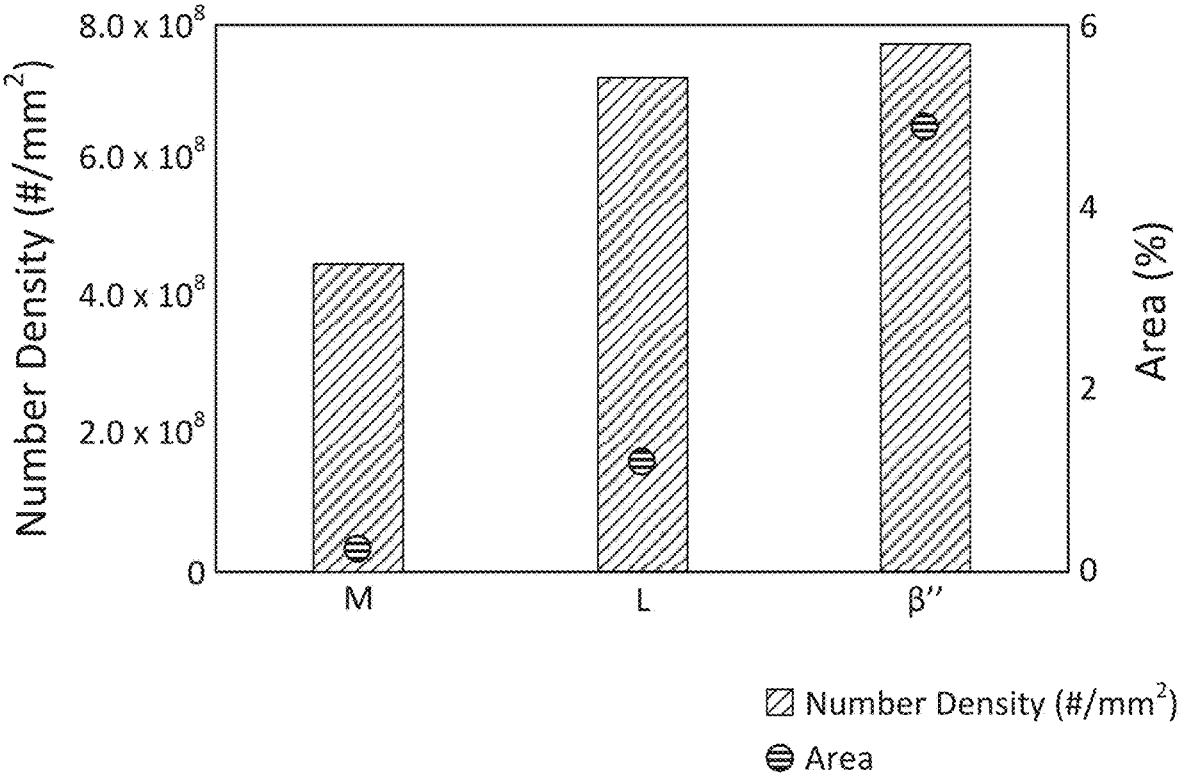
FIG. 5 is a graph showing precipitate composition of an aluminum alloy according to certain aspects of the present disclosure.

FIG. 5 is a graph showing the density of each distinct strengthening precipitate phase, M ($MgZn_2$), L ($Al_4Mg_8Si_7Cu_2$), and β" ($Mg_2Si$), in number of precipitate particles per square millimeter (#/$mm^2$) and as a fraction of analyzed area each distinct precipitate phase occupies (%) for Alloy C (see Table 6). The β" precipitates are predominant in both density and occupied area due to their shape. The smaller M and L precipitates occupy less area accordingly, and are present in densities comparable to the β" precipitates.

Figure 6:
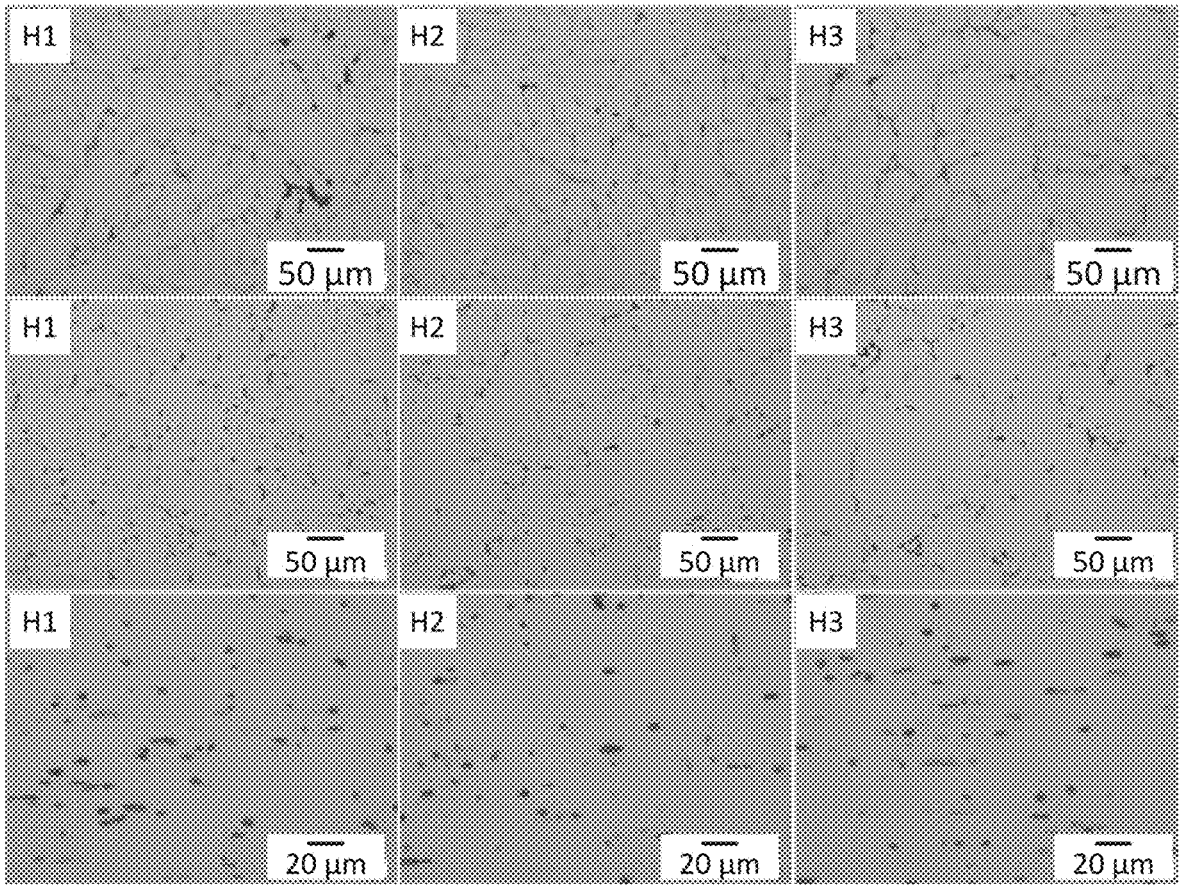
FIG. 6 is a series of optical micrographs showing precipitate formation after various processing steps of an aluminum alloy according to certain aspects of the present disclosure.

FIG. 6 shows optical micrographs of samples of Alloy 3 as described above. Precipitates were analyzed in as-cast samples (top row), homogenized samples (center row), and hot rolled samples reduced to a 10 mm gauge (bottom row). Eutectic phase precipitates are evident in the as-cast samples. Precipitates did not fully dissolve after homogenization, as shown in the center row of micrographs. Coarse (e.g., greater than about 5 microns) precipitates are evident in the hot rolled samples.

Figure 7:
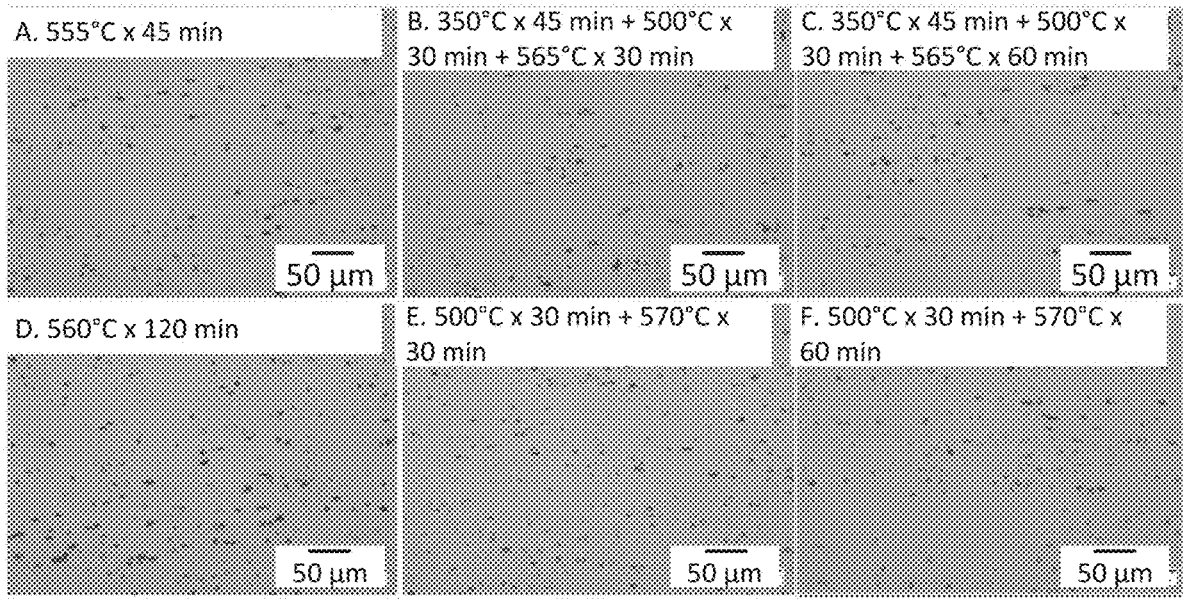
FIG. 7 is a series of optical micrographs showing precipitate formation after various processing steps of an aluminum alloy according to certain aspects of the present disclosure.

FIG. 7 shows optical micrographs of samples of Alloy 3 described above after casting, homogenization, hot rolling to a 10 mm gauge and various solution heat treatment procedures to achieve maximum dissolution of strengthening precipitates during solution heat treatment. FIG. 7, panel A shows an Alloy 3 sample solutionized at a temperature of 555° C. for 45 minutes. FIG. 7, panel B shows an Alloy 3 sample solutionized at a temperature of 350° C. for 45 minutes, then at a temperature of 500° C. for 30 minutes, and finally at a temperature of 565° C. for 30 minutes. FIG. 7, panel C shows an Alloy 3 sample solutionized at a temperature of 350° C. for 45 minutes, then at a temperature of 500° C. for 30 minutes and finally a temperature of 565° C. for 60 minutes. FIG. 7, panel D shows an Alloy 3 sample solutionized at a temperature of 560° C. for 120 minutes. FIG. 7, panel E shows an Alloy 3 sample solutionized at a temperature of 500° C. for 30 minutes, then at a temperature of 570° C. for 30 minutes. FIG. 7, panel F shows an Alloy 3 sample solutionized at a temperature of 500° C. for 30 minutes, then at a temperature of 570° C. for 60 minutes.

Figure 8:
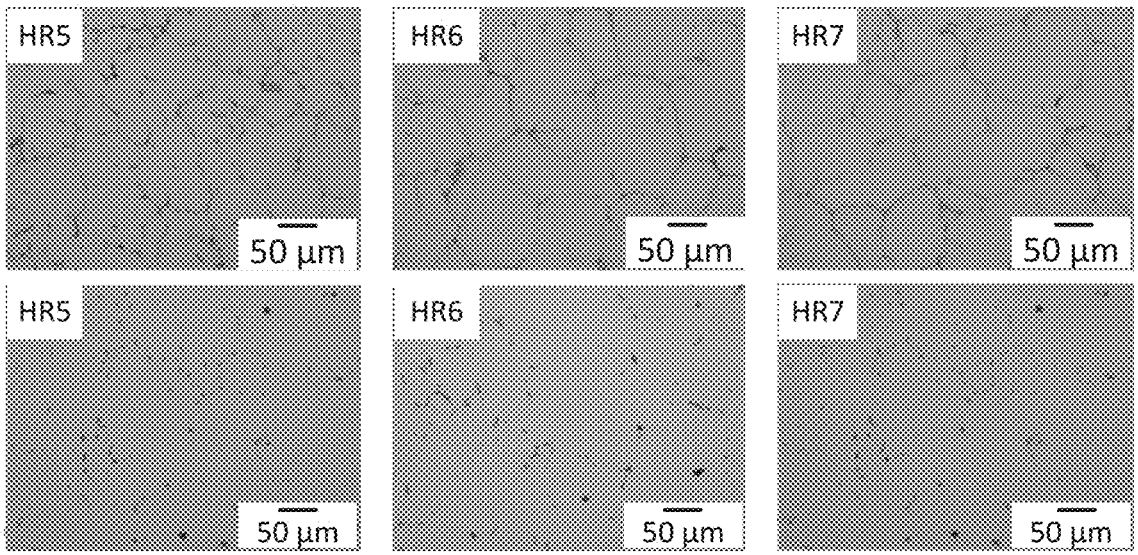
FIG. 8 is a series of optical micrographs showing precipitate formation after various processing steps of an aluminum alloy according to certain aspects of the present disclosure.

FIG. 8 shows optical micrographs of samples of Alloy 5 as described above. Precipitates were analyzed in as-cast samples (top row) and homogenized samples (bottom row). Eutectic phase precipitates are evident in the as-cast samples. The precipitates did not fully dissolve after homogenization, as seen in the bottom row of micrographs. Alloy 5, however, exhibited fewer undissolved precipitates as compared to Alloy 3 after homogenization, due to changes in solute levels (e.g., the Mg levels, Si levels, and the Mg/Si ratio).

Figure 9:
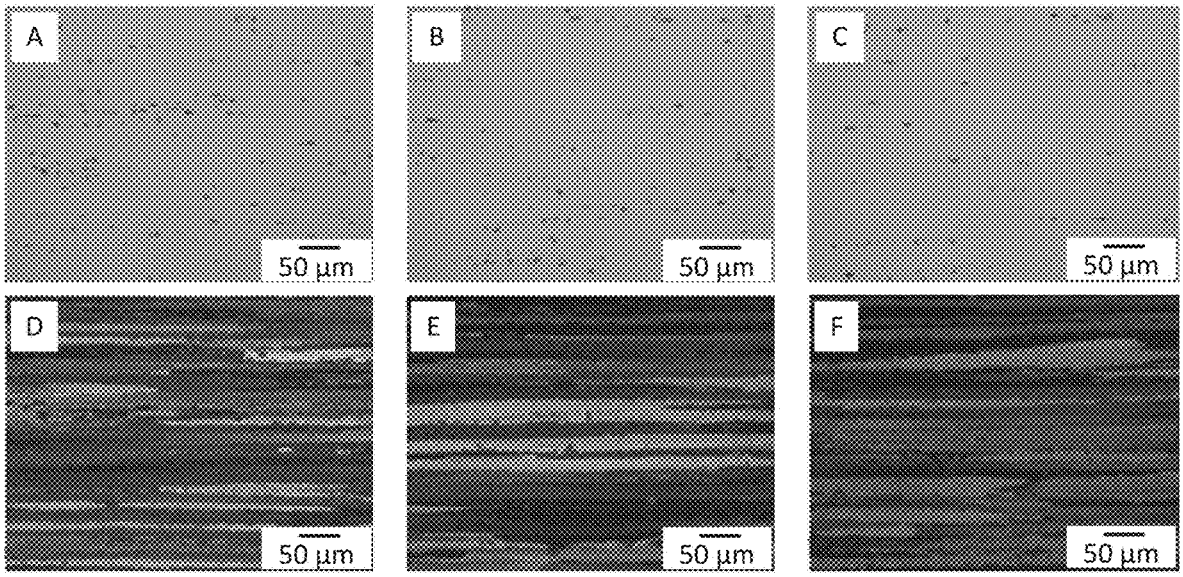
FIG. 9 is a series of optical micrographs showing particle population and grain structure of an aluminum alloy according to certain aspects of the present disclosure.

FIG. 9 shows optical micrographs of samples of Alloy 5 described above after hot rolling to a 10 mm gauge. FIG. 9, panels A, B, and C show precipitate particles (seen as dark spots) in the exemplary alloy samples after hot rolling to a 10 mm gauge. FIG. 9, panels D, E, and F show grain structure after hot rolling the exemplary Alloy 5 samples to a gauge of 10 mm. Grains were not fully recrystallized due to a low hot rolling exit temperature of about 280° C. to about 300° C.

Figure 10:
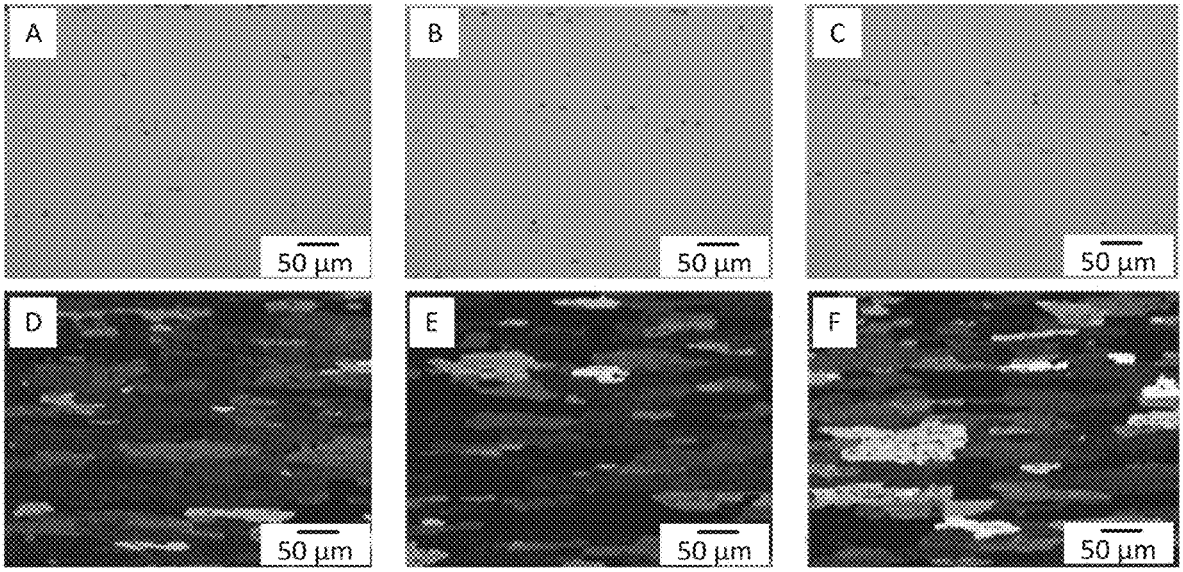
FIG. 10 is a series of optical micrographs showing particle population and grain structure of an aluminum alloy according to certain aspects of the present disclosure.

FIG. 10 shows optical micrographs of samples of Alloy 5 described above after hot rolling to a 10 mm gauge, solution heat treating, and natural aging to a T4 temper. FIG. 10, panels A, B, and C show very few precipitate particles in the exemplary alloy samples in T4 temper. FIG. 10, panels D, E, and F show a fully recrystallized grain structure of the exemplary Alloy 5 samples in T4 temper.

Figure 11:
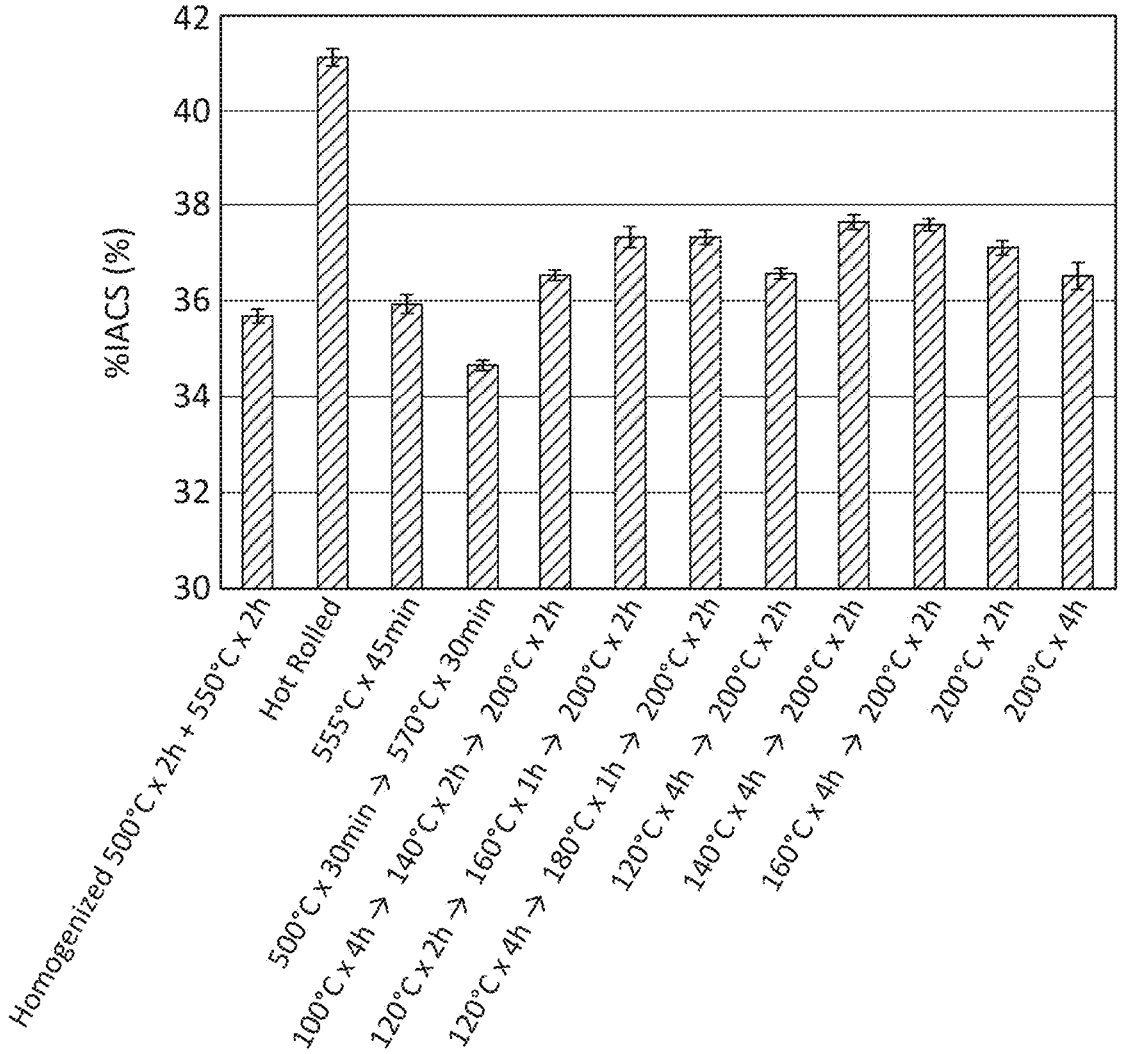
FIG. 11 is a graph showing electrical conductivities of an aluminum alloy according to certain aspects of the present disclosure.

FIG. 11 is a graph showing the electrical conductivities of samples of Alloy 3 after casting, homogenization, hot rolling, various solution heat treatment procedures, and artificial aging (AA). The electrical conductivity data (i.e., conductivity as a percent of the International Annealed Copper Standard (% IACS)) show large amounts of precipitation after hot rolling. Various solution heat treatment procedures were evaluated in an attempt to dissolve the precipitates. Solution heat treating was not effective in dissolving precipitates. Furthermore, there was insufficient strengthening precipitate formation during artificial aging to provide optimal strength.

Figure 12:
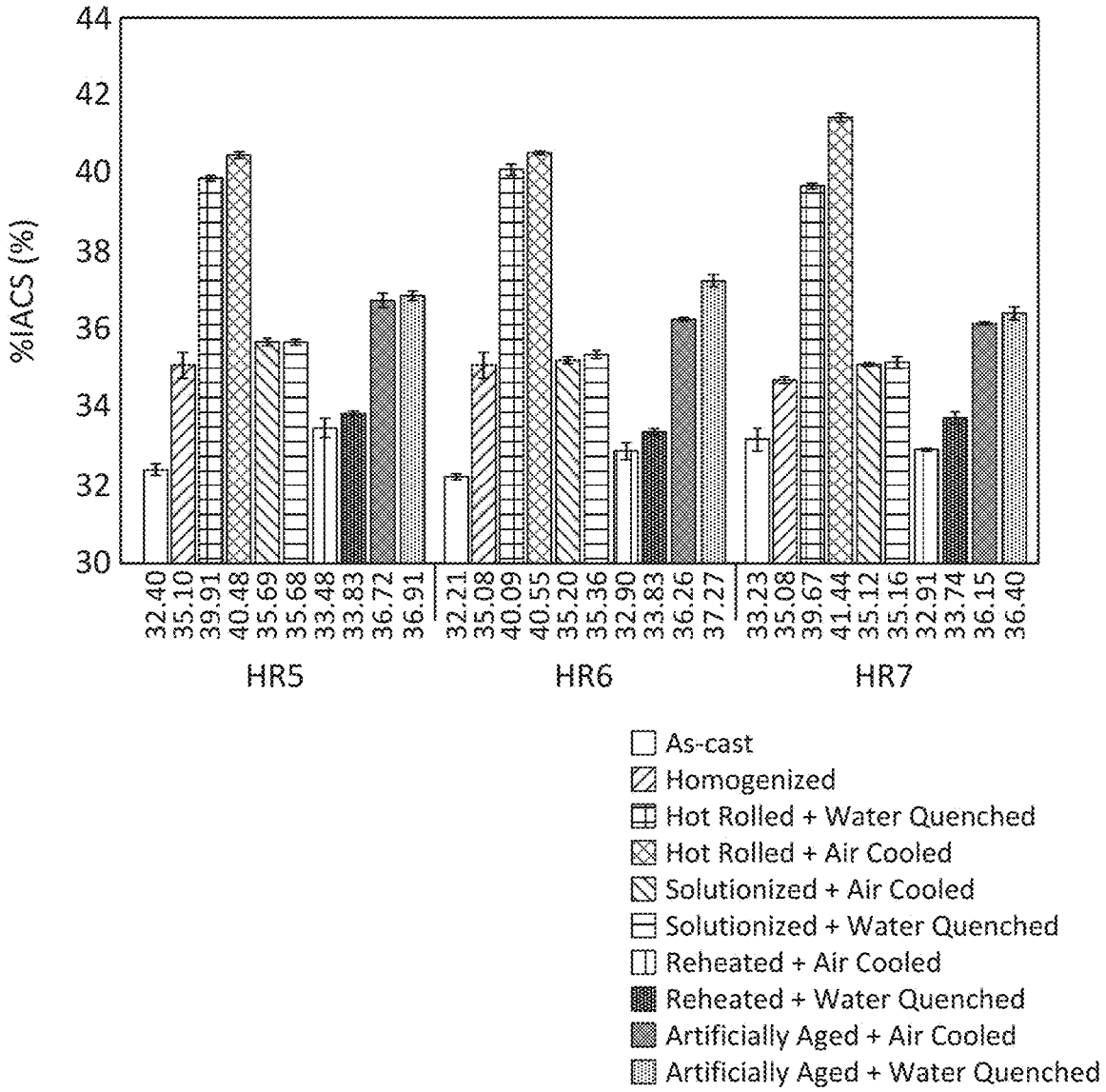
FIG. 12 is a graph showing electrical conductivities of an aluminum alloy according to certain aspects of the present disclosure.

FIG. 12 is a graph showing the electrical conductivities of samples of Alloy 5 (referred to as "HR5," "HR6," and "HR7") after casting, homogenization, hot rolling, solution heat treating, and artificial aging. The electrochemical testing data shows large amounts of precipitation after hot rolling. Various solution heat treatment procedures were evaluated in an attempt to dissolve the precipitates. Solution heat treating was effective in dissolving precipitates. Furthermore, artificial aging provided strengthening precipitate formation providing optimal strength.

Example 3: Aluminum Alloy Mechanical Properties

Figure 13:
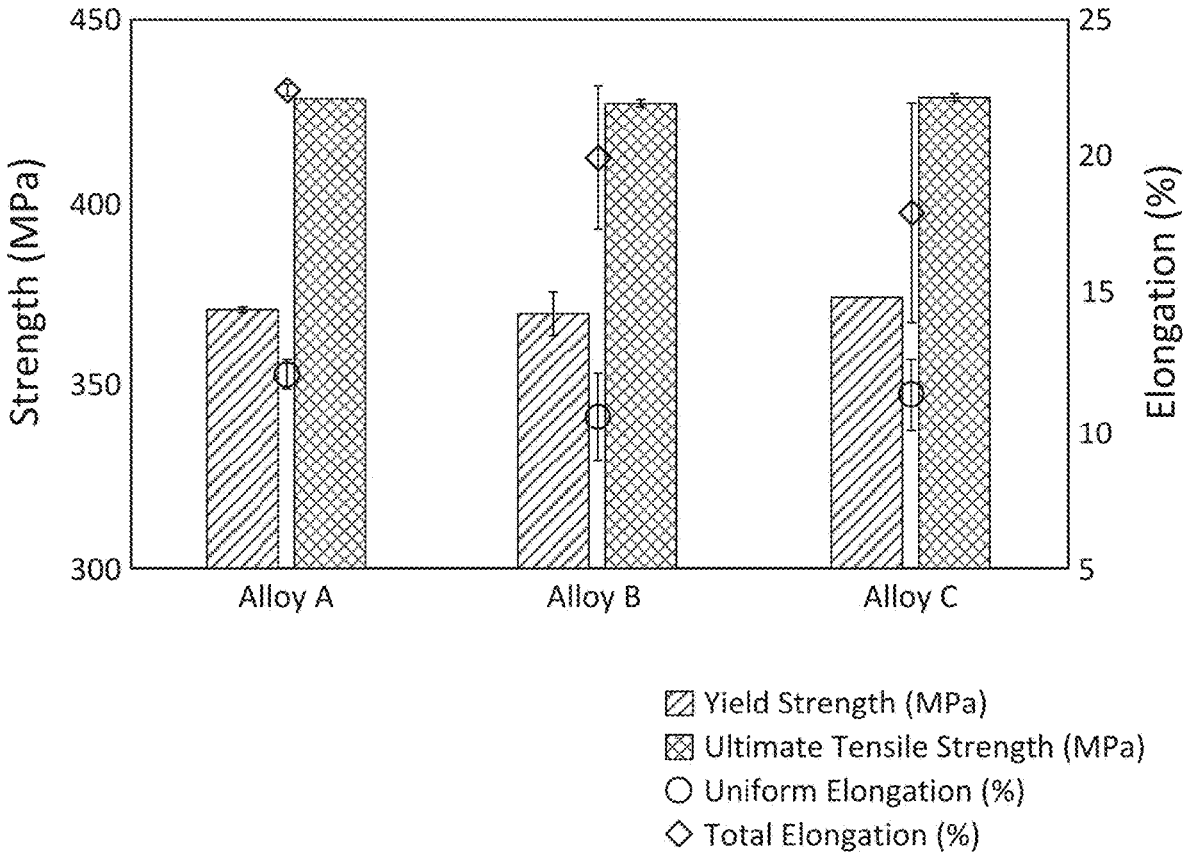
FIG. 13 is a graph showing yield strength (left histogram in each set), ultimate tensile strength (right histogram in each set), uniform elongation (open circle) and total elongation (open diamond) of aluminum alloys according to certain aspects of the present disclosure.

FIG. 13 is a graph showing yield strength (left histogram in each set), ultimate tensile strength (right histogram in each set), uniform elongation (open circle), and total elongation (open diamond) for the exemplary Alloys A, B, and C described above. The alloys were solutionized at a temperature of 565° C. for 45 minutes, pre-aged at a temperature of 125° C. for 2 hours, and artificially aged at a temperature of 200° C. for 4 hours to result in a T6 temper. Each alloy exhibited a yield strength greater than 370 MPa, an ultimate tensile strength greater than 425 MPa, a uniform elongation greater than 10%, and a total elongation greater than 17%. Increased Zn content did not significantly affect the strength of the exemplary aluminum alloys, but did improve resistance to intergranular corrosion and formability.

Figure 14A:
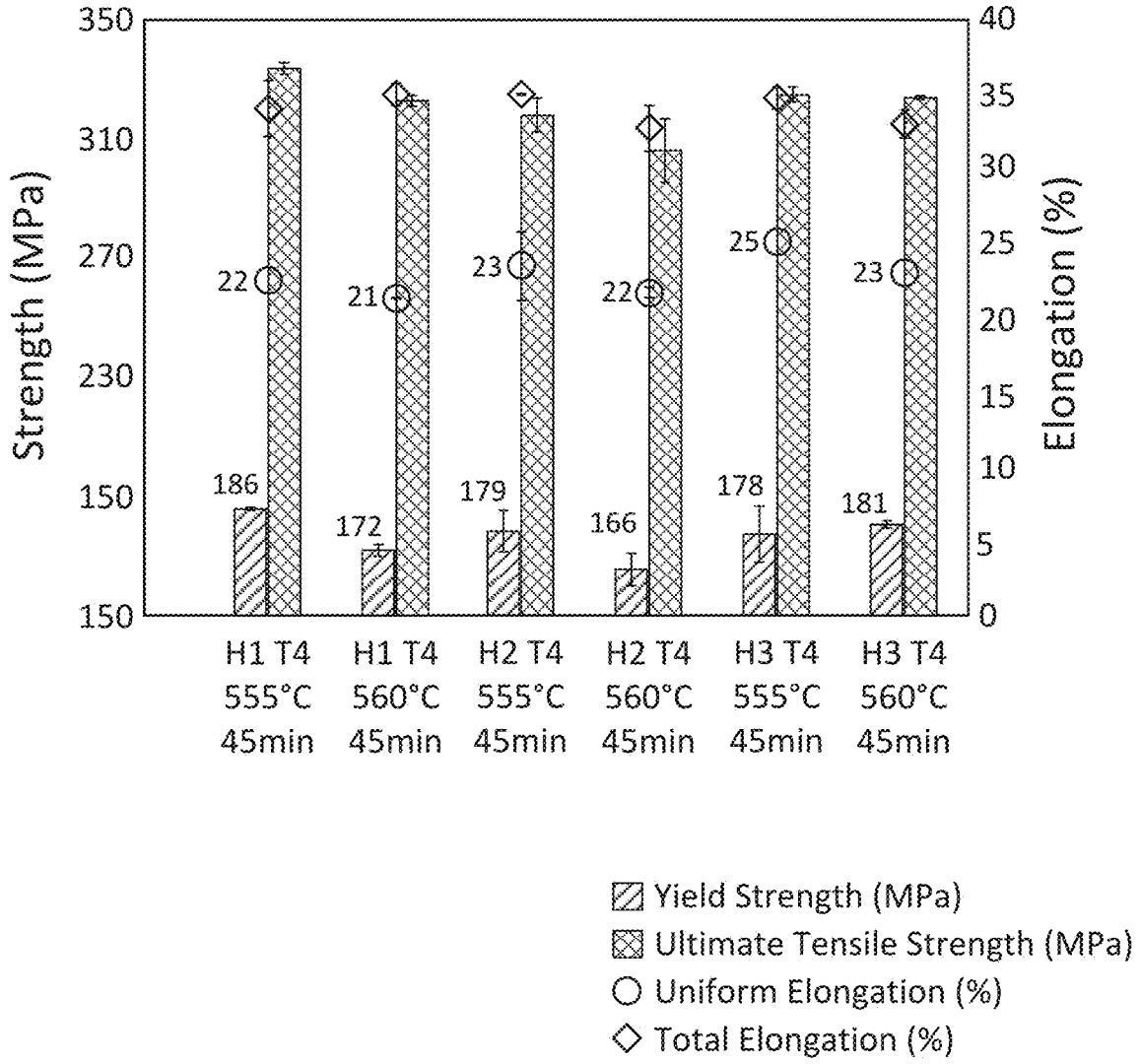
FIG. 14A is a graph showing yield strength (left histogram in each set), ultimate tensile strength (right histogram in each set), uniform elongation (open circle) and total elongation (open diamond) of aluminum alloys according to certain aspects of the present disclosure.
Figure 14B:
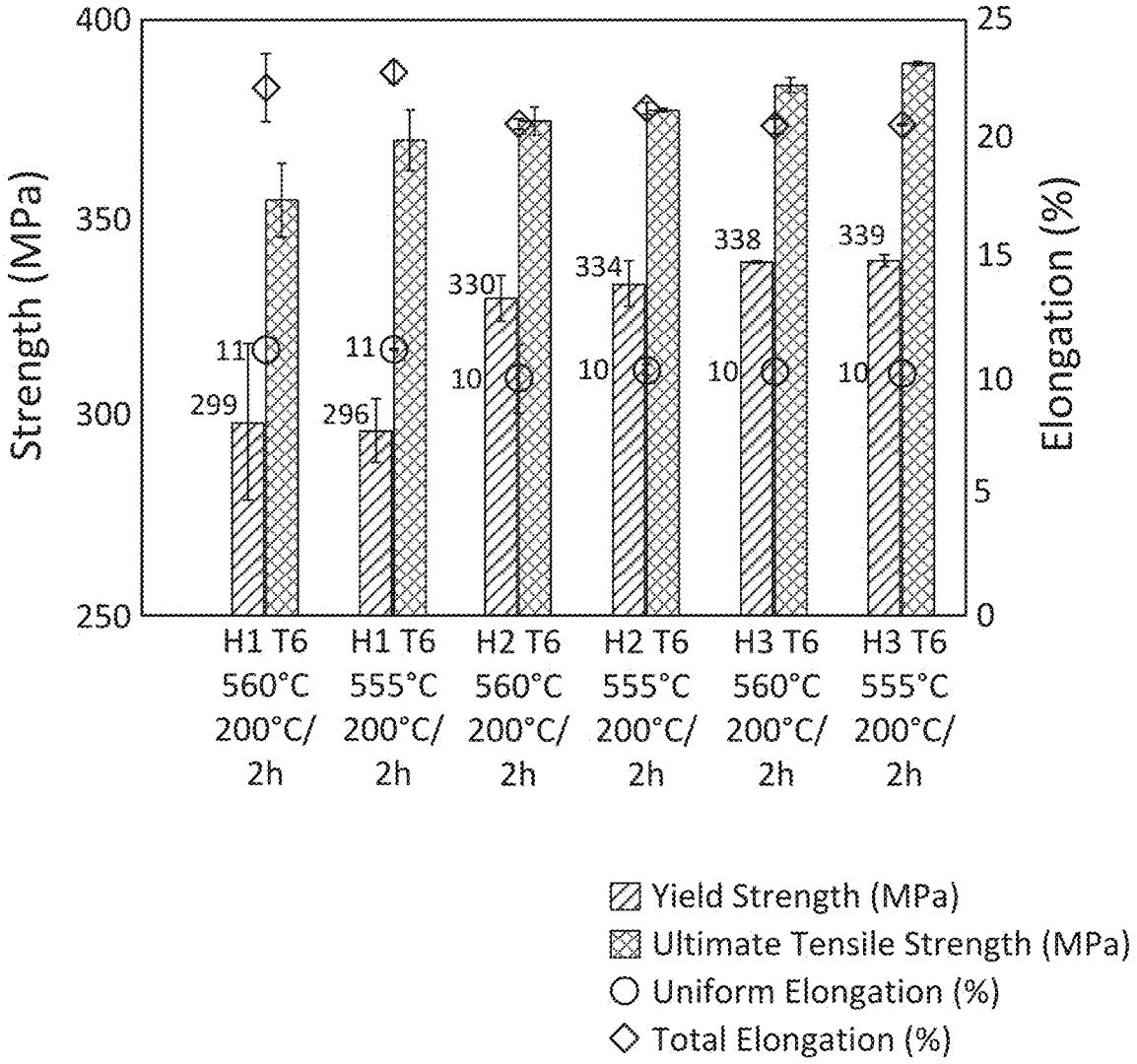
FIG. 14B is a graph showing yield strength (left histogram in each set), ultimate tensile strength (right histogram in each set), uniform elongation (open circle) and total elongation (open diamond) of aluminum alloys according to certain aspects of the present disclosure.

FIG. 14A is a graph showing yield strength (left histogram in each set), ultimate tensile strength (right histogram in each set), uniform elongation (open circle), and total elongation (open diamond) for samples of the exemplary Alloy 3 in T4 temper (referred to as "H1 T4," "H2 T4," and "H3 T4"). FIG. 14B is a graph showing yield strength (left histogram in each set), ultimate tensile strength (right histogram in each set), uniform elongation (open circle), and total elongation (open diamond) for samples of the exemplary Alloy 3 in T6 temper (referred to as "H1 T6," "H2 T6," and "H3 T6").

Figure 15:
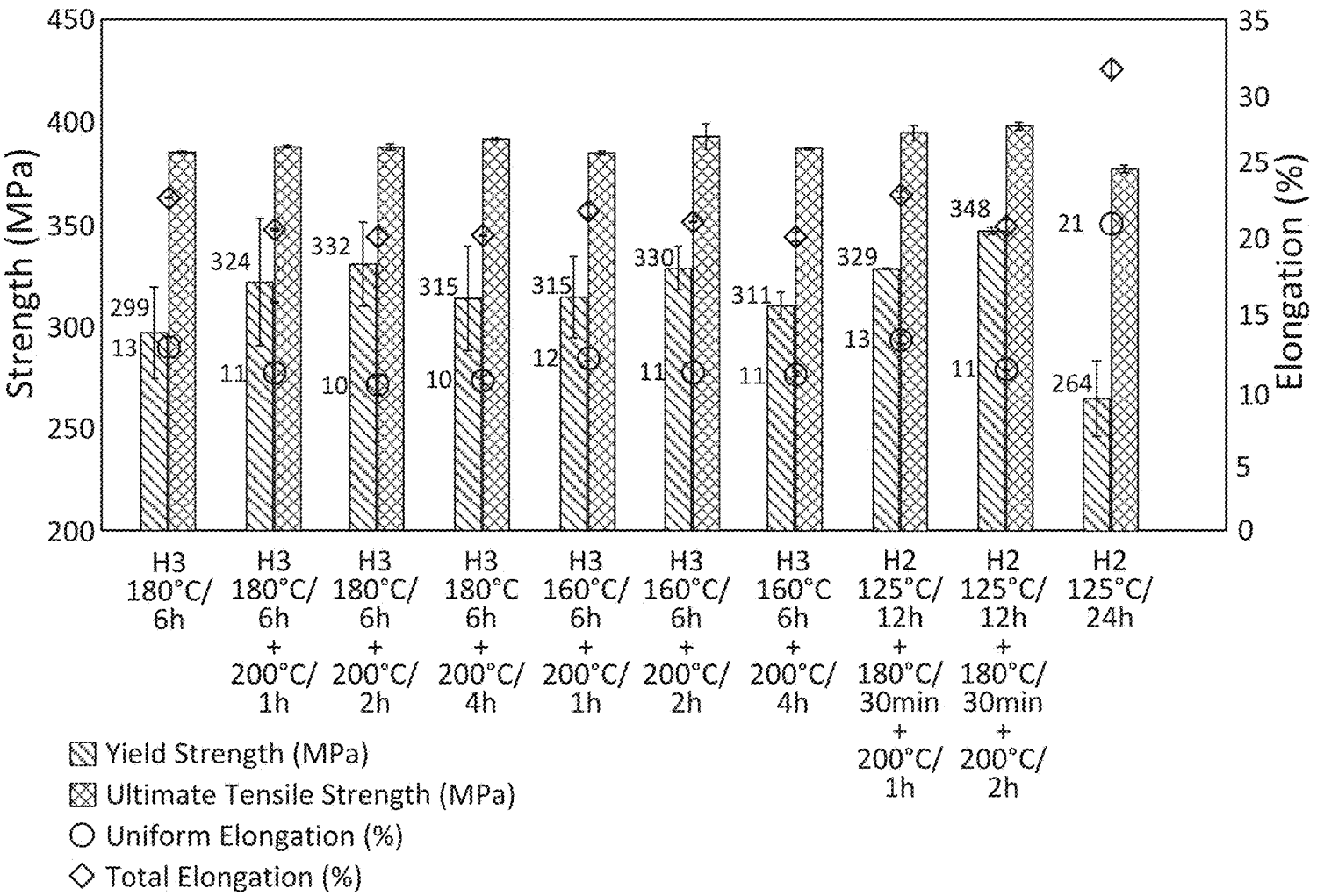
FIG. 15 is a graph showing yield strength (left histogram in each set), ultimate tensile strength (right histogram in each set), uniform elongation (open circle) and total elongation (open diamond) of aluminum alloys according to certain aspects of the present disclosure.

FIG. 15 is a graph showing yield strength (left histogram in each set), ultimate tensile strength (right histogram in each set), uniform elongation (open circle), and total elongation (open diamond) for samples of the exemplary Alloy 3 in T6 temper (referred to as "H1," "H2," and "H3") after various aging procedures, as indicated in the x-axis of the graph. Evident in the graph, a three-step aging procedure was able to produce a high-strength (e.g., 348 MPa) aluminum alloy. Also evident in the graph, aging at low temperatures (e.g., less than 250° C.) was not sufficient to produce strengthening precipitates in the alloy samples.

Figure 16A:
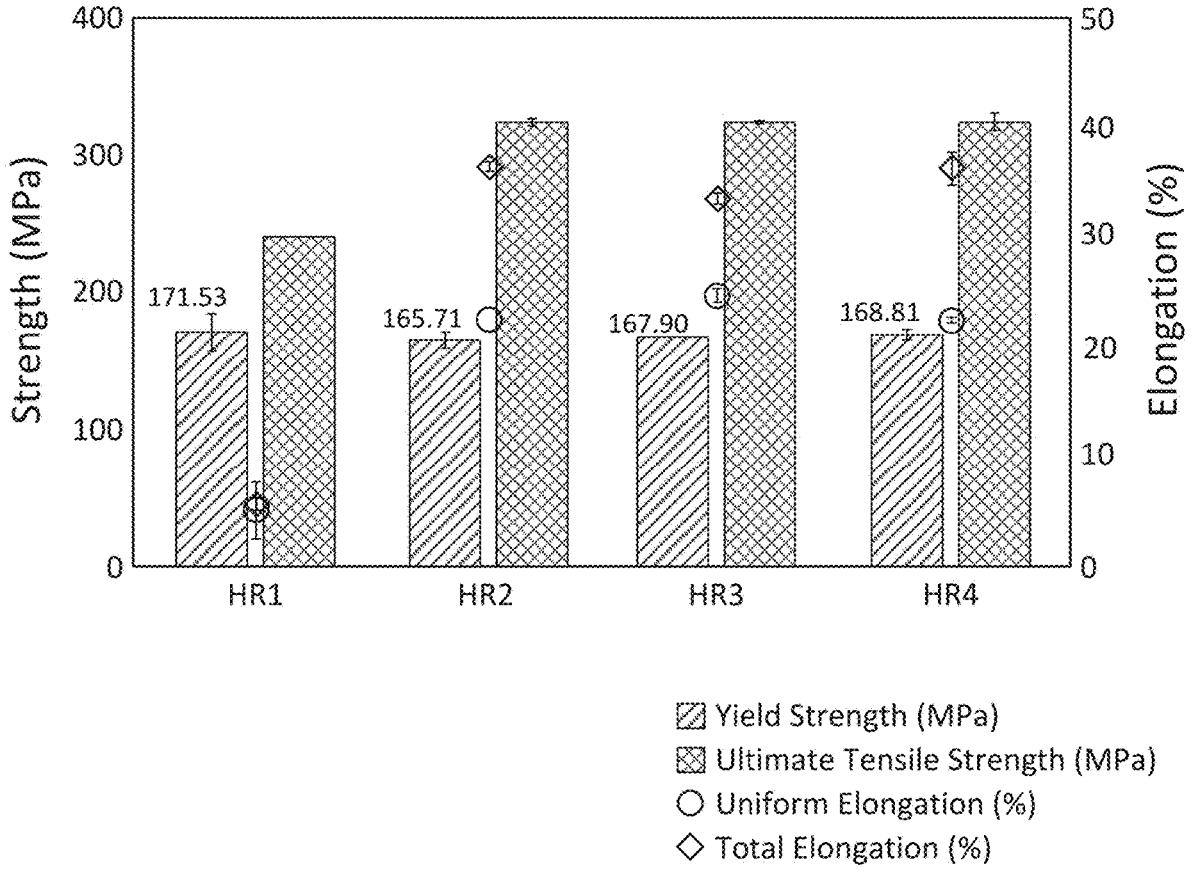
FIG. 16A is a graph showing yield strength (left histogram in each set), ultimate tensile strength (right histogram in each set), uniform elongation (open circle) and total elongation (open diamond) of aluminum alloys according to certain aspects of the present disclosure.
Figure 16B:
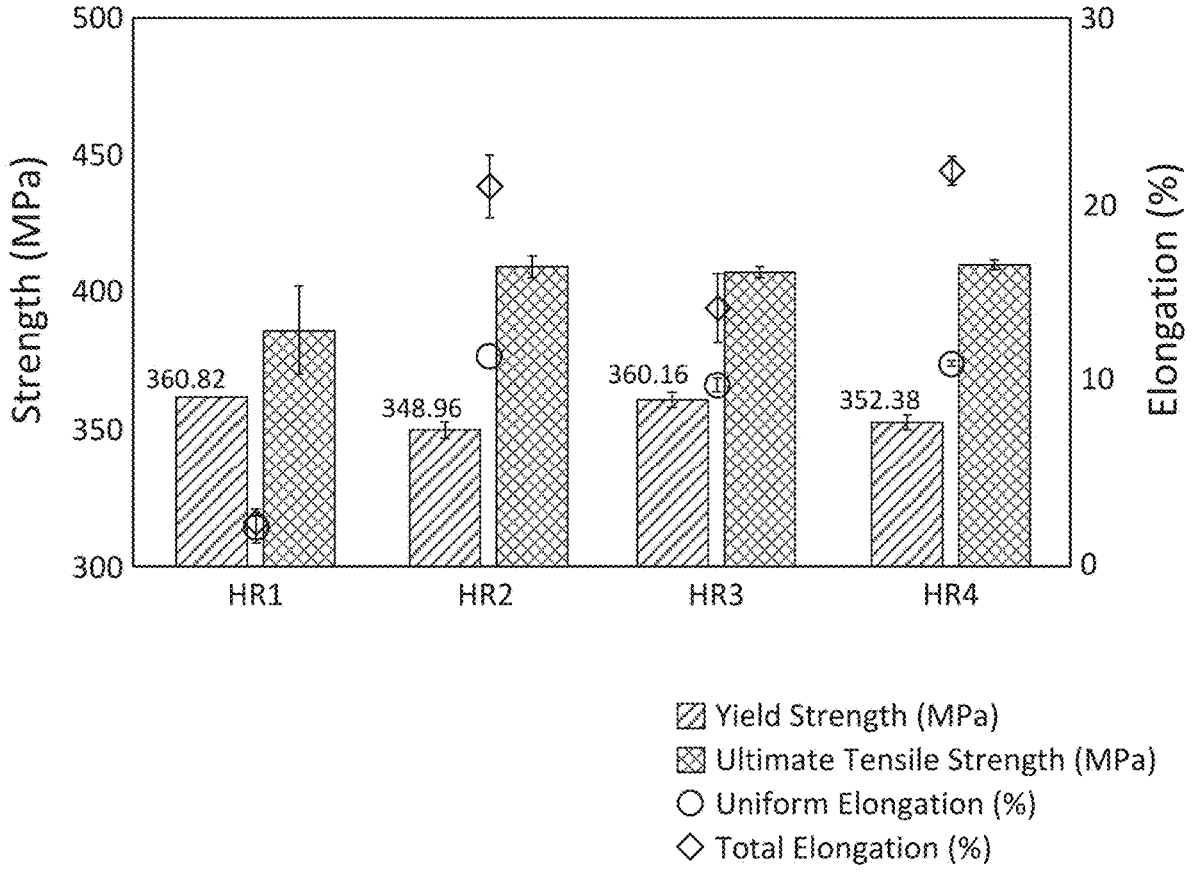
FIG. 16B is a graph showing yield strength (left histogram in each set), ultimate tensile strength (right histogram in each set), uniform elongation (open circle) and total elongation (open diamond) of aluminum alloys according to certain aspects of the present disclosure.

FIG. 16A is a graph showing yield strength (left histogram in each set), ultimate tensile strength (right histogram in each set), uniform elongation (open circle), and total elongation (open diamond) for samples of the exemplary Alloy 4 in T4 temper (referred to as "HR1," "HR2," "HR3," and "HR4"). FIG. 16B is a graph showing yield strength (left histogram in each set), ultimate tensile strength (right histogram in each set), uniform elongation (open circle), and total elongation (open diamond) for samples of the exemplary Alloy 4 in T6 temper after various aging procedures (referred to as "HR1," "HR2," "HR3," and "HR4"). Evident in the graph, a maximum strength of 360 MPa was achieved. Also evident in the graph, aging at low temperatures (e.g., less than 250° C.) was not sufficient to produce strengthening precipitates in the alloy samples.

Figure 17A:
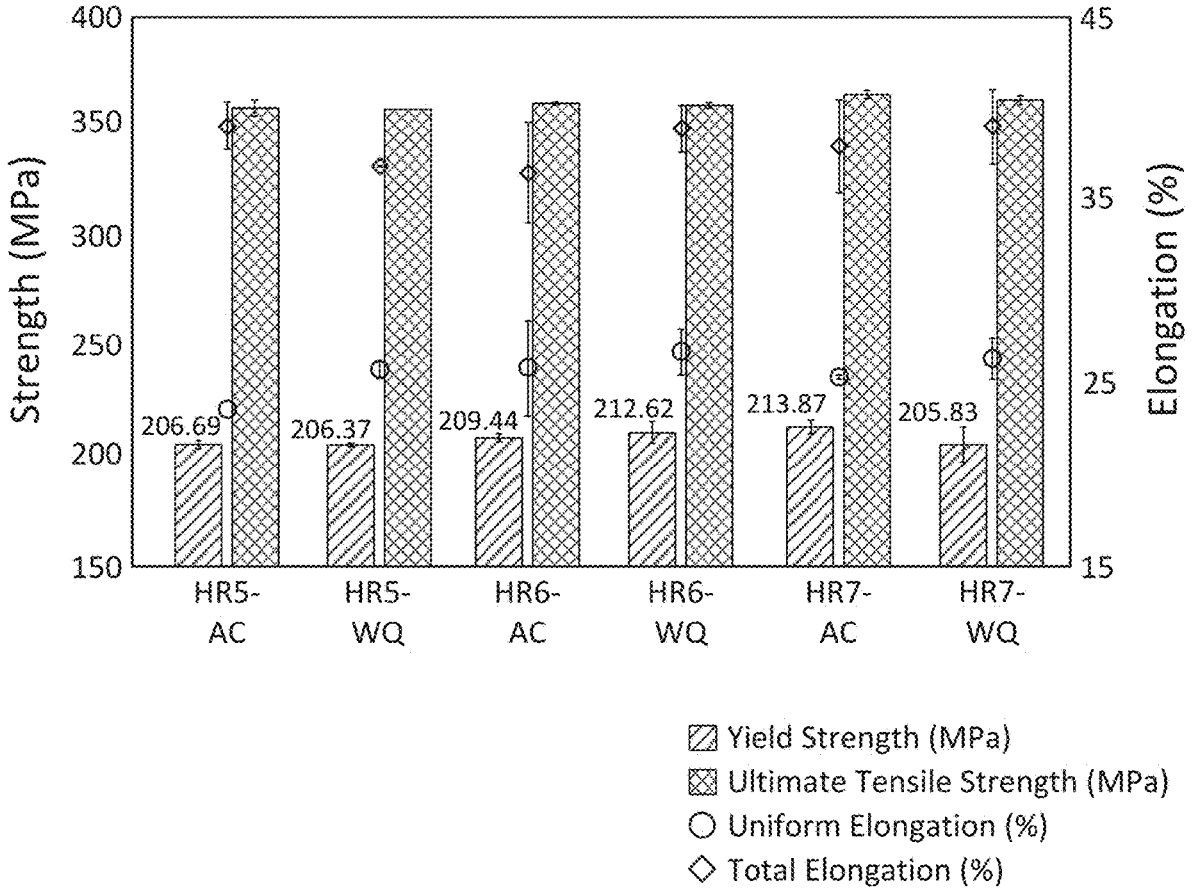
FIG. 17A is a graph showing yield strength (left histogram in each set), ultimate tensile strength (right histogram in each set), uniform elongation (open circle) and total elongation (open diamond) of aluminum alloys according to certain aspects of the present disclosure.
Figure 17B:
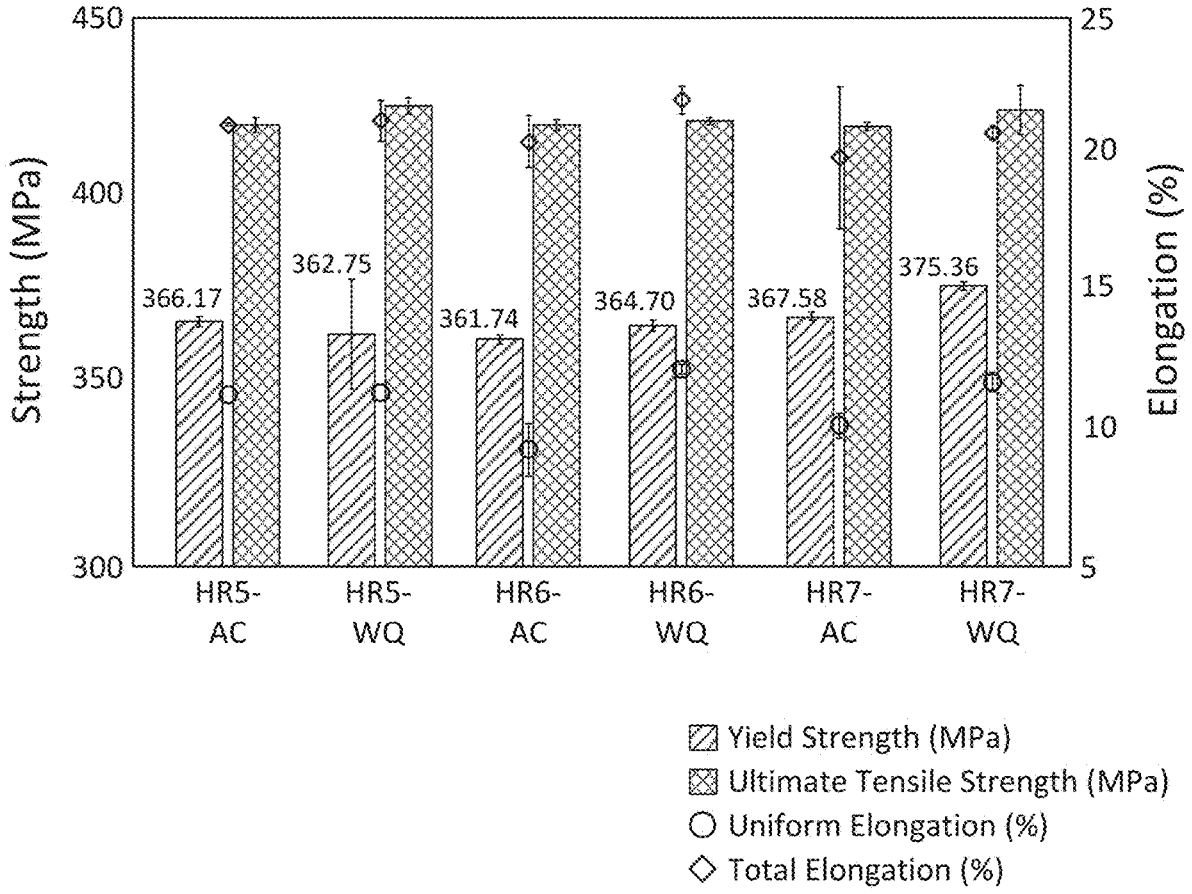
FIG. 17B is a graph showing yield strength (left histogram in each set), ultimate tensile strength (right histogram in each set), uniform elongation (open circle) and total elongation (open diamond) of aluminum alloys according to certain aspects of the present disclosure.

FIG. 17A is a graph showing yield strength (left histogram in each set), ultimate tensile strength (right histogram in each set), uniform elongation (open circle), and total elongation (open diamond) for samples of the exemplary Alloy 5 in T4 temper after casting, homogenization, hot rolling to a gauge of 10 mm, solution heat treating, and various quenching techniques (referred to as "HR5," "HR6," and "HR7"). Air cooled samples are referred to as "AC" and water quenched samples are referred to as "WQ" after hot rolling. FIG. 17B is a graph showing yield strength (left histogram in each set), ultimate tensile strength (right histogram in each set), uniform elongation (open circle), and total elongation (open diamond) for samples of the exemplary Alloy 5 in T6 temper after casting, homogenization, hot rolling to a gauge of 10 mm, solution heat treating, various quenching techniques, and various aging procedures (referred to as "HR5," "HR6," and "HR7"). Air cooled samples are referred to as "AC" and water quenched samples are referred to as "WQ" after hot rolling. Artificial aging to a T6 temper provided high-strength aluminum alloys having yield strengths of about 360 MPa to about 370 MPa.

Figure 18A:
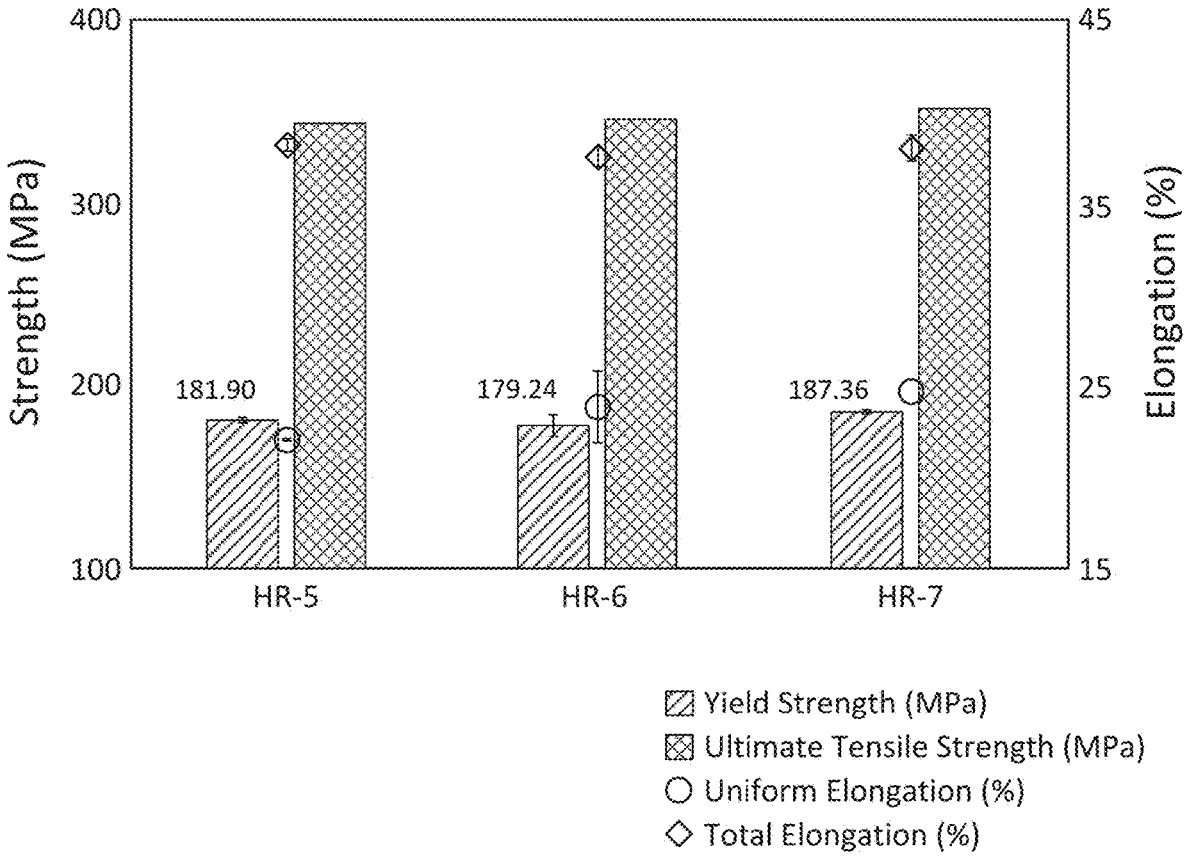
FIG. 18A is a graph showing yield strength (left histogram in each set), ultimate tensile strength (right histogram in each set), uniform elongation (open circle) and total elongation (open diamond) of aluminum alloys according to certain aspects of the present disclosure.
Figure 18B:
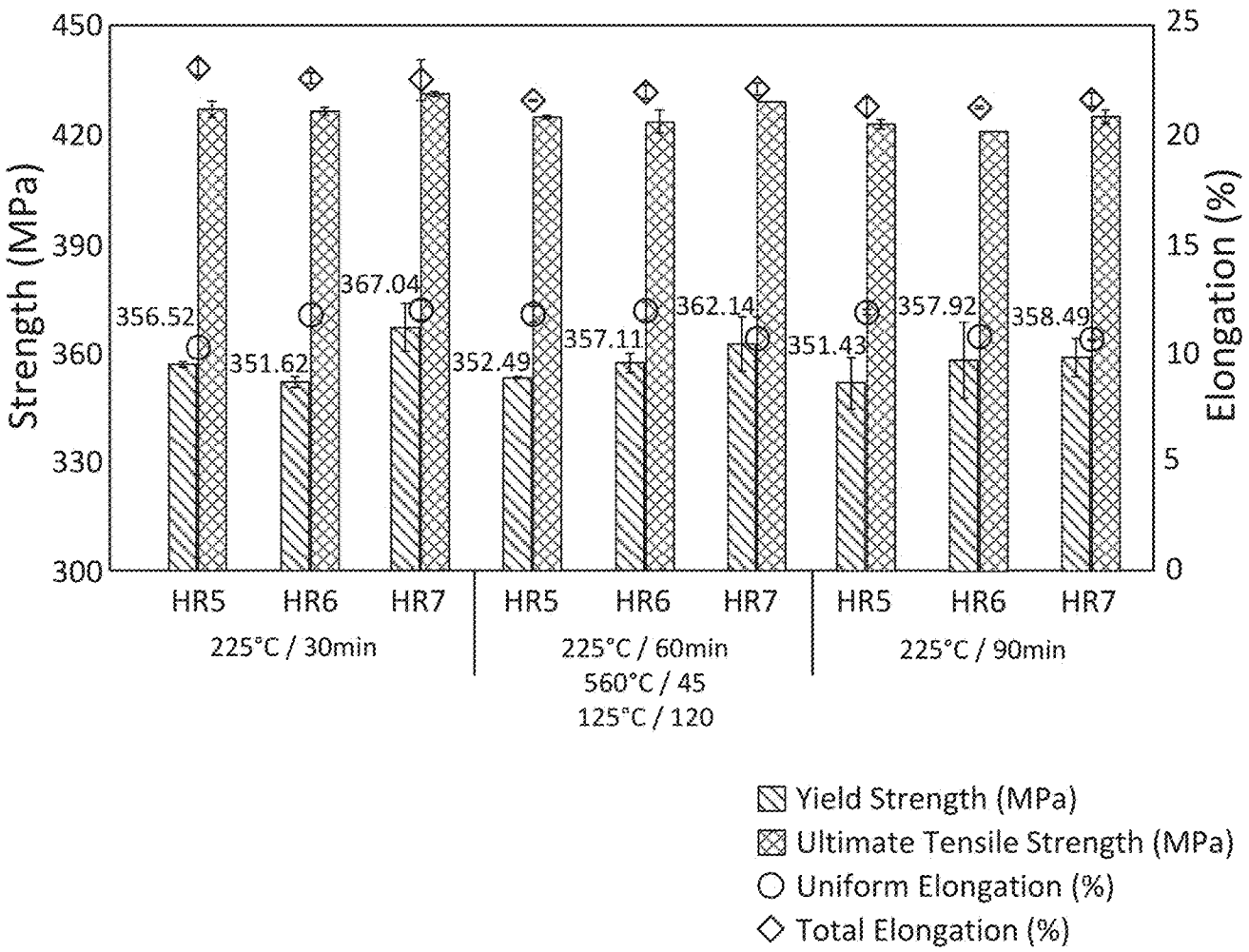
FIG. 18B is a graph showing yield strength (left histogram in each set), ultimate tensile strength (right histogram in each set), uniform elongation (open circle) and total elongation (open diamond) of aluminum alloys according to certain aspects of the present disclosure.

FIG. 18A is a graph showing yield strength (left histogram in each set), ultimate tensile strength (right histogram in each set), uniform elongation (open circle), and total elongation (open diamond) for samples of the exemplary Alloy 5 in T4 temper (referred to as "HR5," "HR6," and "HR7") after casting, homogenization, hot rolling to a gauge of 10 mm, and solution heat treating. FIG. 18B is a graph showing yield strength (left histogram in each set), ultimate tensile strength (right histogram in each set), uniform elongation (open circle), and total elongation (open diamond) for samples of the exemplary Alloy 5 in T6 temper (referred to as "HR5," "HR6," and "HR7") after casting, homogenization, hot rolling to a gauge of 10 mm, solution heat treating, and various aging procedures, as indicated in the graph. Artificial aging to a T6 temper provided high-strength aluminum alloys having yield strengths of about 360 MPa to about 370 MPa.

Figure 19:
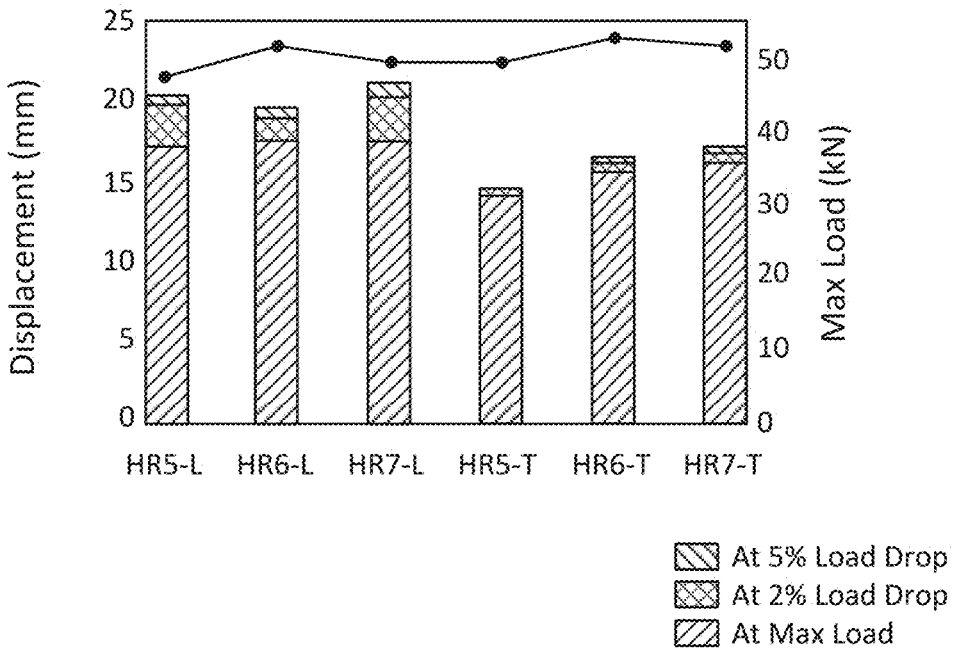
FIG. 19 is a graph showing load displacement data from a 90° bend test of aluminum alloys according to certain aspects of the present disclosure.

FIG. 19 is a graph showing load displacement data for a 90° bend test formability of samples of the exemplary Alloy 5 as described above (referred to as "HR5," "HR6," and "HR7"). Samples tested in a direction longitudinal to a rolling direction are indicated by "–L," and sample tested in a transverse direction to the rolling direction are indicated by "–T." Alloy 5 was subjected to casting, homogenization, hot rolling to a gauge of 10 mm, solution heat treating, and natural aging for one week to provide Alloy 5 samples in T4 temper. Samples were subjected to a 90° bend test and load displacement (left axis) and maximum load (right axis) were recorded.

Figure 20:
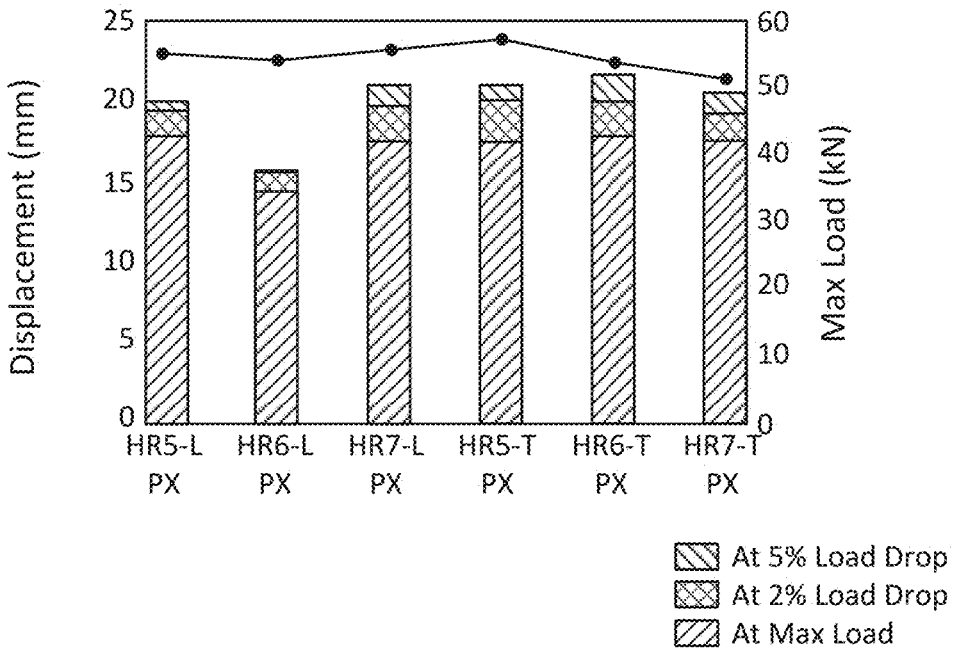
FIG. 20 is a graph showing load displacement data from a 90° bend test of aluminum alloys according to certain aspects of the present disclosure.

FIG. 20 is a graph showing load displacement data for a 90° bend test formability of samples of the exemplary Alloy 5 as described above (referred to as "HR5," "HR6," and "HR7"). Samples tested in a direction longitudinal to a rolling direction are indicated by "–L," and sample tested in a transverse direction to the rolling direction are indicated by "–T." Alloy 5 was subjected to casting, homogenization, hot rolling to a gauge of 10 mm, solution heat treating, pre-aging at a temperature of 125° C. for 2 hours (referred to as "PX") and natural aging for one week to provide Alloy 5 samples in T4 temper. Samples were subjected to a 90° bend test and load displacement (left axis) and maximum load (right axis) were recorded.

Figure 21:
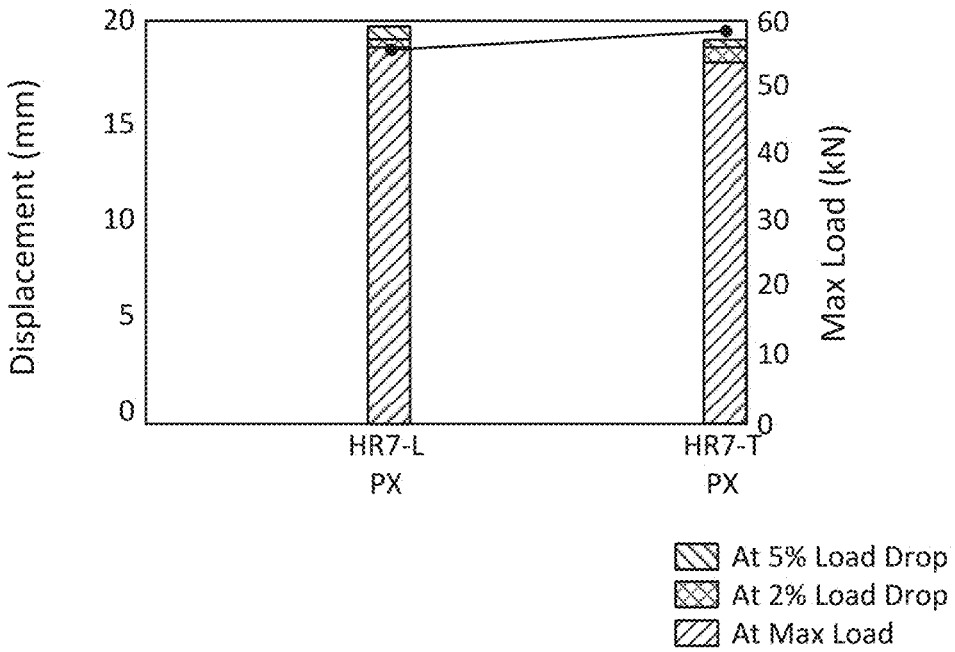
FIG. 21 is a graph showing load displacement data from a 90° bend test of an aluminum alloy according to certain aspects of the present disclosure.

FIG. 21 is a graph showing load displacement data for a 90° bend test formability of samples of the exemplary Alloy 5 as described above. The sample tested in a direction longitudinal to a rolling direction is indicated by "–L" and the sample tested in a transverse direction to the rolling direction is indicated by "–T." The samples were subjected to casting, homogenization, hot rolling to a gauge of 10 mm, solution heat treating, pre-aging at a temperature of 125° C. for 2 hours and natural aging for one month to provide Alloy 5 samples in T4 temper. The samples were subjected to a 90° bend test and load displacement (left axis) and maximum load (right axis) were recorded. There was no noticeable change in formability from one week of natural aging to one month of natural aging with pre-aging employed during production.

Figure 22:
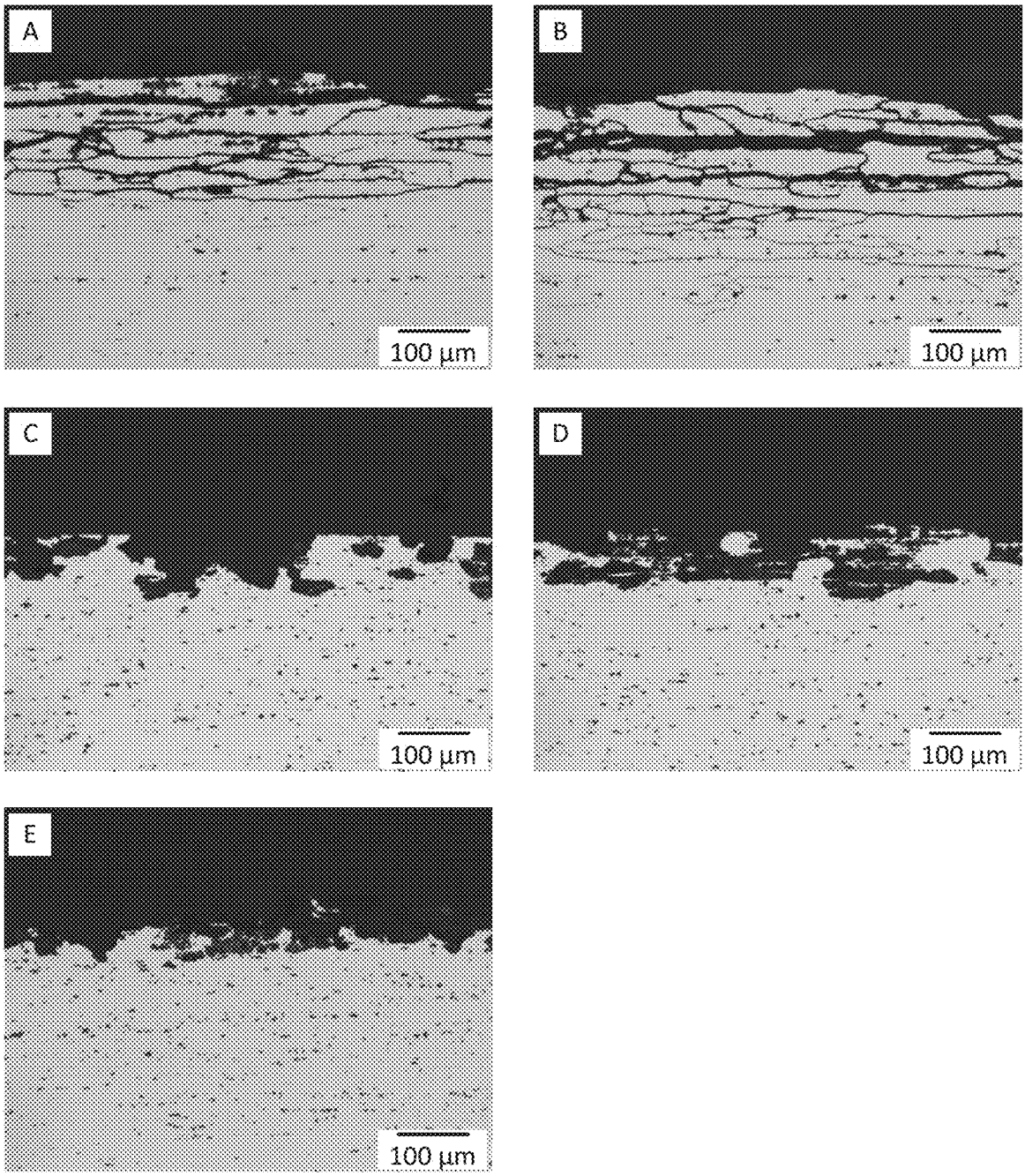
FIG. 22 is a series of optical micrographs showing corrosion attack in aluminum alloys according to certain aspects of the present disclosure.

FIG. 22 shows optical micrographs showing the effects of corrosion testing on alloys described above. The alloys were subjected to corrosion testing according to ISO standard 11846B (e.g., 24 hour immersion in a solution containing 3.0 wt. % sodium chloride (NaCl) and 1.0 volume % hydrochloric acid (HCl) in water). FIG. 22, panel A, and FIG. 22, panel B show effects of corrosion testing in comparative Alloy 2 described above. Corrosion morphology is an intergranular corrosion (IGC) attack. FIG. 22, panels C, D, and E show the effects of corrosion testing in exemplary Alloy 3 as described above. Corrosion morphology is a pitting attack. A pitting attack is a more desirable corrosion morphology causing less damage to the alloy and indicating corrosion resistance in the exemplary alloys.

Figure 23:
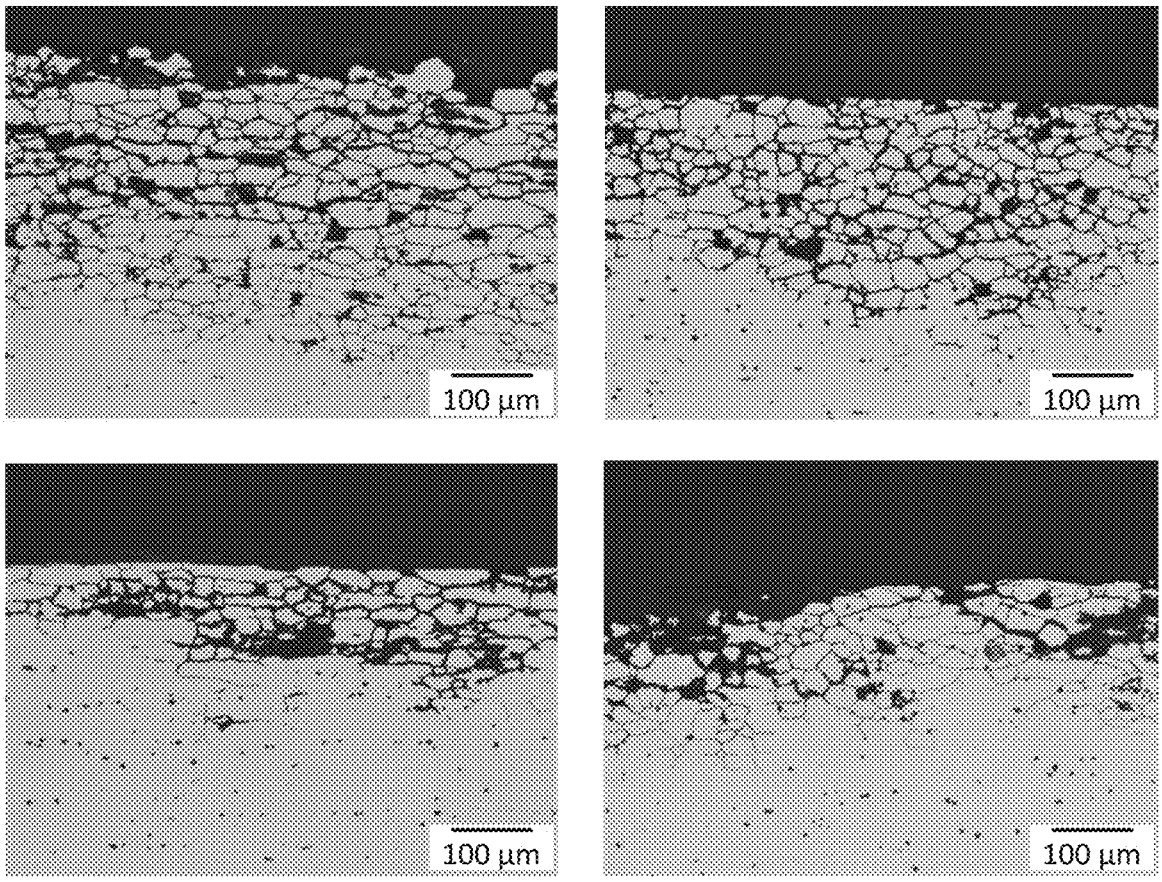
FIG. 23 is a series of optical micrographs showing corrosion attack in aluminum alloys according to certain aspects of the present disclosure.

FIG. 23 shows optical micrographs showing the effects of corrosion testing on samples of exemplary Alloy 4 as described above. Evident in the micrographs is significant IGC attack due to the composition of Alloy 4, wherein the ratio of Cu/[Zn/(Mg/Si)] is within the range of from about 0.7 to about 1.4, but the ratio of Zn/(Mg/Si) is not within the range of from about 0.75 to about 1.4, resulting in significant IGC attack.

Figure 24A:
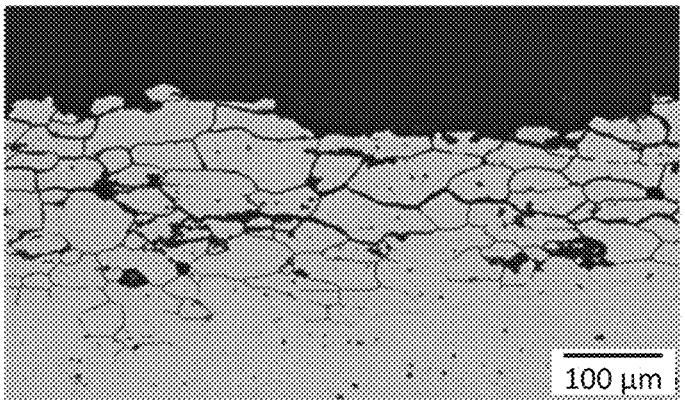
FIG. 24A is an optical micrograph of an aluminum alloy according to certain aspects of the present disclosure.
Figure 24B:
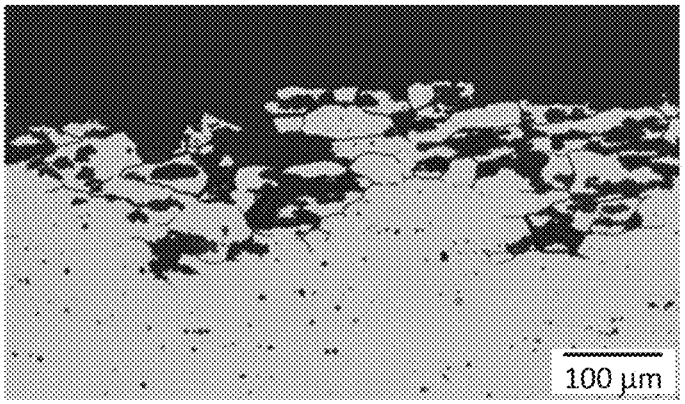
FIG. 24B is an optical micrograph of an aluminum alloy according to certain aspects of the present disclosure.
Figure 24C:
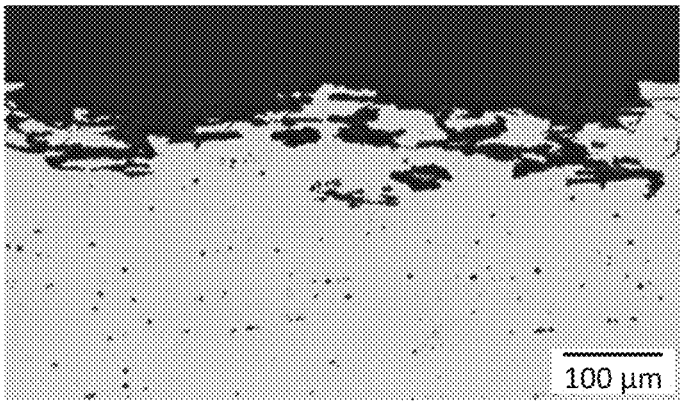
FIG. 24C is an optical micrograph of an aluminum alloy according to certain aspects of the present disclosure.

FIGS. 24A, 24B, and 24C are optical micrographs showing the results of corrosion testing on the exemplary alloys described above. FIG. 24A shows intergranular corrosion (IGC) attack in Alloy A. FIG. 24B shows intergranular corrosion attack in Alloy B. FIG. 24C shows intergranular corrosion attack in Alloy C. Evident in FIGS. 24A, 24B, and 24C, increasing Zn content changes corrosion morphology from IGC to pitting, and corrosion attack depth is decreased from about 150 μm (Alloy A, FIG. 24A) to less than 100 μm (Alloy C, FIG. 24C).

All patents, publications, and abstracts cited above are incorporated herein by reference in their entireties. Various embodiments of the invention have been described in fulfillment of the various objectives of the invention. It should be recognized that these embodiments are merely illustrative of the principles of the present invention. Numerous modifications and adaptions thereof will be readily apparent to those skilled in the art without departing from the spirit and scope of the present invention as defined in the following claims.

What is claimed is:

1. An aluminum alloy comprising about 0.25-1.3 wt. % Si, 1.0-2.5 wt. % Mg, 0.5-1.5 wt. % Cu, up to 0.2 wt. % Fe, up to 3.0 wt. % Zn, up to 0.15 wt. % impurities, and Al, wherein a ratio of Mg to Si (Mg/Si ratio) is from about 1.5 to 1 to about 3.5 to 1 and wherein a ratio of Zn to the Mg/Si ratio (Zn/(Mg/Si) ratio) is from about 0.75 to 1 to about 1.4 to 1.

2. The aluminum alloy of claim 1, comprising about 0.55-1.1 wt. % Si, 1.25-2.25 wt. % Mg, 0.6-1.0 wt. % Cu, 0.05-0.17 wt. % Fe, 1.5-3.0 wt. % Zn, up to 0.15 wt. % impurities, and Al.

3. The aluminum alloy of claim 1, comprising about 0.65-1.0 wt. % Si, 1.5-2.25 wt. % Mg, 0.6-1.0 wt. % Cu, 0.12-0.17 wt. % Fe, 2.0-3.0 wt. % Zn, up to 0.15 wt. % impurities, and Al.

4. The aluminum alloy of claim 1, further comprising Zr.

5. The aluminum alloy of claim 4, wherein Zr is present in an amount of up to about 0.15 wt. %.

6. The aluminum alloy of claim 5, wherein Zr is present in an amount of from about 0.09-0.12 wt. %.

7. The aluminum alloy of claim 1, further comprising Mn.

8. The aluminum alloy of claim 7, wherein Mn is present in an amount of up to about 0.5 wt. %.

9. The aluminum alloy of claim 8, wherein Mn is present in an amount of from about 0.05-0.3 wt. %.

10. The aluminum alloy of claim 1, wherein the Mg/Si ratio is from about 2.0 to 1 to about 3.0 to 1.

11. The aluminum alloy of claim 1, wherein the Zn/(Mg/Si) ratio is from about 0.8 to 1 to about 1.1 to 1.

12. The aluminum alloy of claim 1, wherein a ratio of Cu to the Zn/(Mg/Si) ratio (Cu/[Zn/(Mg/Si)] ratio) is from about 0.7 to 1 to about 1.4 to 1.

13. The aluminum alloy of claim 12, wherein the Cu/[Zn/(Mg/Si)] ratio is from about 0.8 to 1 to about 1.1 to 1.

14. An aluminum alloy product, comprising the aluminum alloy according to claim 1.

15. The aluminum alloy product of claim 14, wherein the aluminum alloy product comprises a yield strength of at least about 340 MPa in T6 temper.

16. The aluminum alloy product of claim 15, wherein the yield strength is from about 360 MPa to about 380 MPa in T6 temper.

17. The aluminum alloy product of claim 14, wherein the aluminum alloy product comprises an average intergranular corrosion pit depth of less than 100 μm in T6 temper.

18. The aluminum alloy product of claim 14, wherein the aluminum alloy product comprises an r/t (bendability) ratio of about 0.5 or less in T4 temper.

19. The aluminum alloy product of claim 14, wherein the aluminum alloy product comprises one or more precipitates selected from the group consisting of $MgZn_2/Mg(Zn,Cu)_2$, $Mg_2Si$, and $Al_4Mg_8Si_7Cu_2$.

20. The aluminum alloy product of claim 19, wherein the aluminum alloy product comprises $MgZn_2/Mg(Zn,Cu)_2$ in an average amount of at least about 300,000,000 particles per $mm^2$.

21. The aluminum alloy product of claim 19, wherein the aluminum alloy product comprises $Mg_2Si$ in an average amount of at least about 600,000,000 particles per $mm^2$.

22. The aluminum alloy product of claim 19, wherein the aluminum alloy product comprises $Al_4Mg_8Si_7Cu_2$ in an average amount of at least about 600,000,000 particles per $mm^2$.

23. The aluminum alloy product of claim 19, wherein the aluminum alloy product comprises $MgZn_2/Mg(Zn,Cu)_2$, $Mg_2Si$, and $Al_4Mg_8Si_7Cu_2$.

24. The aluminum alloy product of claim 23, wherein a ratio of $Mg_2Si$ to $Al_4Mg_8Si_7Cu_2$ is from about 1:1 to about 1.5:1.

25. The aluminum alloy product of claim 23, wherein a ratio of $Mg_2Si$ to $MgZn_2/Mg(Zn,Cu)_2$ is from about 1.5:1 to about 3:1.

26. The aluminum alloy product of claim 23, wherein a ratio of $Al_4Mg_8Si_7Cu_2$ to $MgZn_2/Mg(Zn,Cu)_2$ is from about 1.5:1 to about 3:1.

27. A method of producing an aluminum alloy, comprising:

casting an aluminum alloy according to claim 1 to form an aluminum alloy cast product;

homogenizing the aluminum alloy cast product;

hot rolling to provide a final gauge aluminum alloy; and solution heat treating the final gauge aluminum alloy.

28. The method of claim 27, further comprising pre-aging the final gauge aluminum alloy.

29. The method of claim 27, wherein the aluminum alloy is cast from molten aluminum alloy comprising scrap metal.

30. The method of claim 29, wherein the scrap metal comprises a 6xxx series aluminum alloy, a 7xxx series aluminum alloy, or a combination of these.

* * * * *